US007378807B2

(12) United States Patent
Feldtkeller et al.

(10) Patent No.: US 7,378,807 B2
(45) Date of Patent: May 27, 2008

(54) DRIVE CIRCUIT FOR A FLUORESCENT LAMP WITH A DIAGNOSIS CIRCUIT, AND METHOD FOR DIAGNOSIS OF A FLUORESCENT LAMP

(75) Inventors: Martin Feldtkeller, Munich (DE); Michael Herfurth, Gilching (DE); Antoine Fery, Munich (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/195,376

(22) Filed: Aug. 2, 2005

(65) Prior Publication Data

US 2006/0033450 A1 Feb. 16, 2006

(30) Foreign Application Priority Data

Aug. 2, 2004 (DE) ..... 10 2004 037 390

(51) Int. Cl.
*H05B 37/02* (2006.01)

(52) U.S. Cl. ..... 315/308; 315/308; 315/291

(58) Field of Classification Search ..... 315/291, 315/242, 224, 276, 307, 308
See application file for complete search history.

(56) References Cited

U.S. PATENT DOCUMENTS

| | | | | |
|---|---|---|---|---|
| 5,808,422 | A | 9/1998 | Venkitasubrahmanian et al. | |
| 5,925,990 | A | 7/1999 | Crouse et al. | 315/291 |
| 5,973,943 | A | 10/1999 | Ribarich et al. | |
| 6,008,592 | A | 12/1999 | Ribarich | 315/225 |
| 6,008,593 | A | 12/1999 | Ribarich | 315/307 |
| 6,043,612 | A * | 3/2000 | Knobloch et al. | 315/224 |
| 6,366,032 | B1 | 4/2002 | Allison et al. | 315/307 |
| 6,400,095 | B1 | 6/2002 | Primisser et al. | |
| 6,429,603 | B1 | 8/2002 | Tsugita et al. | 315/224 |
| 6,617,805 | B2 | 9/2003 | Ribarich et al. | |
| 2003/0160574 | A1 * | 8/2003 | Gray | 315/291 |

FOREIGN PATENT DOCUMENTS

| | | | |
|---|---|---|---|
| DE | 102 06 731 A1 | 8/2003 | |
| EP | 0 681 414 A2 | 11/1995 | |
| EP | 1 066 739 B1 | 2/2002 | |
| WO | WO 01/56337 A1 | 2/2001 | 315/307 |
| WO | WO 03/069963 A1 | 8/2003 | |

* cited by examiner

*Primary Examiner*—Trinh Dinh
*Assistant Examiner*—Dieu Hien T Duong
(74) *Attorney, Agent, or Firm*—Maginot, Moore & Beck

(57) ABSTRACT

A drive circuit for at least one fluorescent lamp has a half-bridge circuit for production of a supply voltage a resonant tuned circuit coupled to the half-bridge circuit and to which the at least one fluorescent lamp can be connected, a diagnosis circuit with a resistance element coupled to the resonant tuned circuit, at least one current/voltage converter connected to the resistance element that produces at least one measurement voltage from a current flowing through the resistance element, and an evaluation circuit which is connected to the current/voltage converter and is supplied with the at least one measurement voltage and to a method for diagnosis of a fluorescent lamp.

36 Claims, 12 Drawing Sheets

DRIVE CIRCUIT FOR A FLUORESCENT LAMP WITH A DIAGNOSIS CIRCUIT, AND METHOD FOR DIAGNOSIS OF A FLUORESCENT LAMP

FIELD OF THE INVENTION

The present invention relates to a drive circuit for a fluorescent lamp, and to a method for diagnosis of a fluorescent lamp.

BACKGROUND

In order to assist understanding of the invention which will be explained in the following text, the basic design and method of operation of an electronic ballast which is used to drive a fluorescent lamp, and its method of operation, will first of all be explained with reference to FIGS. 1 to 3. One such ballast is described, by way of example, in EP 1 066 739 B1, in U.S. Pat. No. 5,973,943 or in U.S. Pat. No. 6,617,805 B2.

The ballast has a half-bridge with a first semiconductor switching element Q1 and a second semiconductor switching element Q2, whose load paths are connected in series between terminals K1, K2 between which a DC voltage Vb is applied. This DC voltage Vb is produced (in a manner which is not illustrated in any more detail), for example, by means of a generally known power factor correction circuit (Power Factor Controller PFC) from a mains AC voltage. This DC voltage Vb has a normal amplitude value of 400 V.

The half-bridge circuit Q1, Q2 uses this DC voltage Vb to produce a voltage V2 with a pulsed signal waveform at an output K3. The two semiconductor switching elements are driven in a pulsed manner by a drive circuit 20 via drive signals S1, S2 in order to produce this pulsed voltage V2. This drive is intended to minimize switching losses, such that the two switching elements Q1, Q2 are never switched on at the same time, and such that both switching elements are switched off for a predetermined time period at the same time during a switching process. The frequency with which the two switching elements are driven in a pulsed manner and at which the pulsed voltage V2 is produced is dependent, inter alia, on the burning state of the fluorescent lamp 10 that is supplied by the circuit and, once the lamp is burning, is, for example, 40 kHz. This frequency is adjusted by the drive circuit in a fundamentally known manner. Signal inputs via which the drive circuit receives information about the burning status of the lamp, and apparatuses for production of such signals, are not illustrated in the figures, for clarity reasons. The figures likewise do not show circuit components for supplying voltage to the drive circuit.

The fluorescent lamp 10 is connected in parallel with a resonant capacitor C1 which is part of a resonant tuned circuit. This resonant tuned circuit which, in addition to the resonant capacitor C1, has a resonant inductance L1 connected in series with the resonant capacitor C1, is connected to one output K3 of the half-bridge Q1, Q2 and is supplied by the pulsed supply voltage V2. A blocking capacitor C2 which is connected in series with the resonant tuned circuit L1, C1 is used to filter out the DC voltage component from the pulsed supply voltage V2, thus resulting in an AC voltage with an approximately square or trapezoidal signal waveform across the arrangement with the resonant tuned circuit L1, C1 and the fluorescent lamp 10. The amplitude of this AC voltage is approximately half the magnitude of the DC voltage that is applied to the half-bridge Q1, Q2.

After being started, the fluorescent lamp 10 behaves like a voltage-dependent resistance. A voltage which is dropped across the lamp 10 after it has been started has a waveform which approximates to a sinusoidal curve.

Before the lamp 10 is started, the lamp electrodes 11, 12 must be preheated to an emission temperature. For this purpose, the supply voltage V2 is produced at a higher frequency than after starting, thus resulting in a voltage V10 which is less than a burning voltage on the lamp 10. After the end of the preheating phase, the drive frequency of the half-bridge circuit Q1, Q2 is reduced in order to reach a burning voltage, which is sufficient for the lamp to burn, and thus to start the lamp.

In order to preheat the lamp electrodes 11, 12, the lamp may be connected in the resonant tuned circuit in various ways. In the example shown in FIG. 1, the current in the resonant tuned circuit L1, L2 flows through the electrodes 11, 12, in order to preheat them. In the example shown in FIG. 2, auxiliary inductances Lh1, Lh2 are provided for preheating of the electrodes 11, 12, are inductively coupled to the resonant inductance L1 and are respectively connected to one of the electrodes 11, 12 in order to preheat them.

The arrangement with the resonant tuned circuit L1, C1 and the fluorescent lamp 10 can be connected, with reference to FIGS. 1 and 2, between the output K3 of the half-bridge circuit Q1, Q2 and a reference ground potential GND, or with reference to FIG. 3 between the output K3 of the half-bridge circuit Q1, Q2 and the center tap of a capacitive voltage divider C4, C5 which is connected between the input terminals K1, K2.

A snubber capacitor C3 is connected in parallel with the load path of the second semiconductor switching element Q2 of the half-bridge circuit, with the object of allowing zero voltage switching operation (ZVS) of the two semiconductor switching elements Q1, Q2.

Fluorescent lamps have a finite life. Towards the end of this life, when the lamp is worn, the emission capability of the lamp electrodes 11, 12, which emit electrons into a fluorescent gas during operation, falls. As these electrons move from the metal of the electrodes 11, 12 into the gas discharge, this normally actually results in a sufficiently large amount of heat being produced to keep the electrodes 11, 12 at the temperature that is required for emission. If these emission conditions deteriorate as a result of wear, then a greater voltage drop occurs on the electrodes, and this leads to a larger amount of heat being produced, and to poorer lamp efficiency. While relatively old lamp types were normally able to withstand locally greater power loss without damage owing to their larger dimensions, this greater power loss and the greater amount of heat that is produced resulting from it in the case of relatively new lamp types, for example in the case of lamps with a diameter of ⅝", can in the extreme lead to the glass surrounding the lamp melting. It is therefore necessary to identify the end of the life of fluorescent lamps in good time, in order to avoid such damage.

When the end of the life of a lamp is reached, the voltage V10 across the lamp rises. One of the two electrodes 11, 12 will normally wear earlier than the other, so that the lamp voltage V10 becomes unbalanced, that is to say one of the positive or negative half-cycles has a greater amplitude than the respective other half-cycle. Based on this knowledge, it is known for the wear of a fluorescent lamp to be detected by forming the arithmetic mean value of the lamp voltage and comparing this with zero. If this arithmetic mean value differs by more than a predetermined amount from zero, thus indicating an unbalanced lamp voltage, it is assumed that the end of life has been reached.

Methods such as these, in which the arithmetic mean value of the lamp voltage is evaluated for wear detection, are described by way of example in U.S. Pat. No. 5,808,422 or EP 0 681 414 A2. These methods make use of the fact that the arithmetic mean value of the lamp voltage V10 plus half the supply voltage Vb is dropped on the blocking capacitor c2, and can thus be measured and monitored relatively easily.

The known methods have the disadvantage that their implementation requires a comparatively large number of components, which cannot be integrated.

SUMMARY

The aim of the present invention is thus to provide a drive circuit for a fluorescent lamp, which allows reliable diagnosis of wear of the fluorescent lamp, and which can be largely integrated, and to provide a method for diagnosis of a fluorescent lamp.

The drive circuit according to the invention for at least one fluorescent lamp has the following features:

- a half-bridge circuit for production of a supply voltage,
- a resonant tuned circuit which is coupled to the half-bridge circuit and to which the at least one fluorescent lamp can be connected,
- a diagnosis circuit with a resistance element which is coupled to the resonant tuned circuit, at least one current/voltage converter which is connected to the resistance element and produces at least one measurement voltage from a current flowing through the resistance element, and an evaluation circuit which is connected to the current/voltage converter and is supplied with the at least one measurement voltage.

The method according to the invention for diagnosis of at least one fluorescent lamp, which has connections for application of a periodic operation voltage, with the method comprising the following method steps:

- production of at least one periodic unipolar signal which is dependent on the operating voltage,
- determination of a first and a second peak value of the periodic signal,
- comparison of the peak values or comparison of in each case one peak value with a value which is derived from the respective other peak value in order to produce a wear signal as a function of the comparison result.

The subject matter of the invention also relates to a drive circuit for at least one fluorescent lamp, which has the following features:

- a half-bridge circuit for production of a supply voltage,
- a resonant tuned circuit which is coupled to the half-bridge circuit and to which the at least one fluorescent lamp can be connected,
- a direct-current path which contains the resistance element and can be closed by an intact lamp filament in the fluorescent lamp and to which a detector circuit is connected for detection of a direct current flowing through the direct-current path.

The present invention will be explained in more detail in the following text using exemplary embodiments and with reference to the figures.

BRIEF DESCRIPTION OF THE DRAWINGS

Unless stated to the contrary, identical reference symbols denote identical circuit components and signals with the same meaning in the figures.

DETAILED DESCRIPTION

Figure 1:
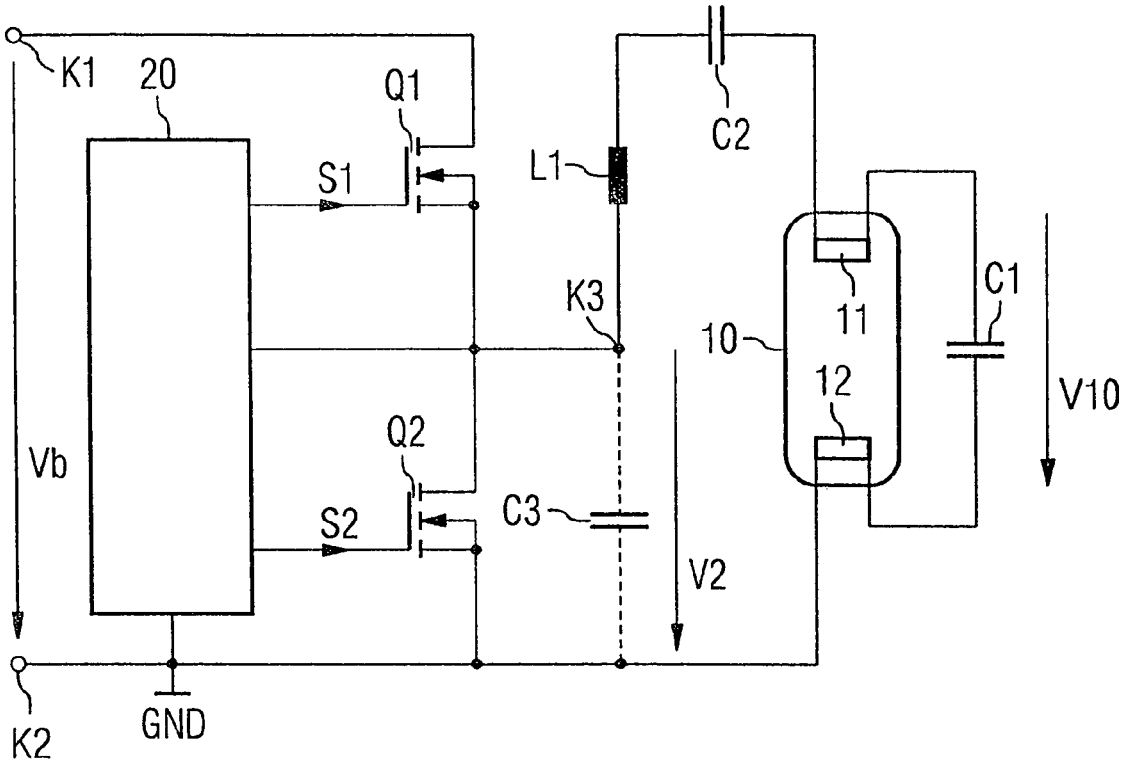
FIG 1 Prior art
FIG. 1 shows a first drive circuit for a fluorescent lamp according to the prior art.
Figure 2:
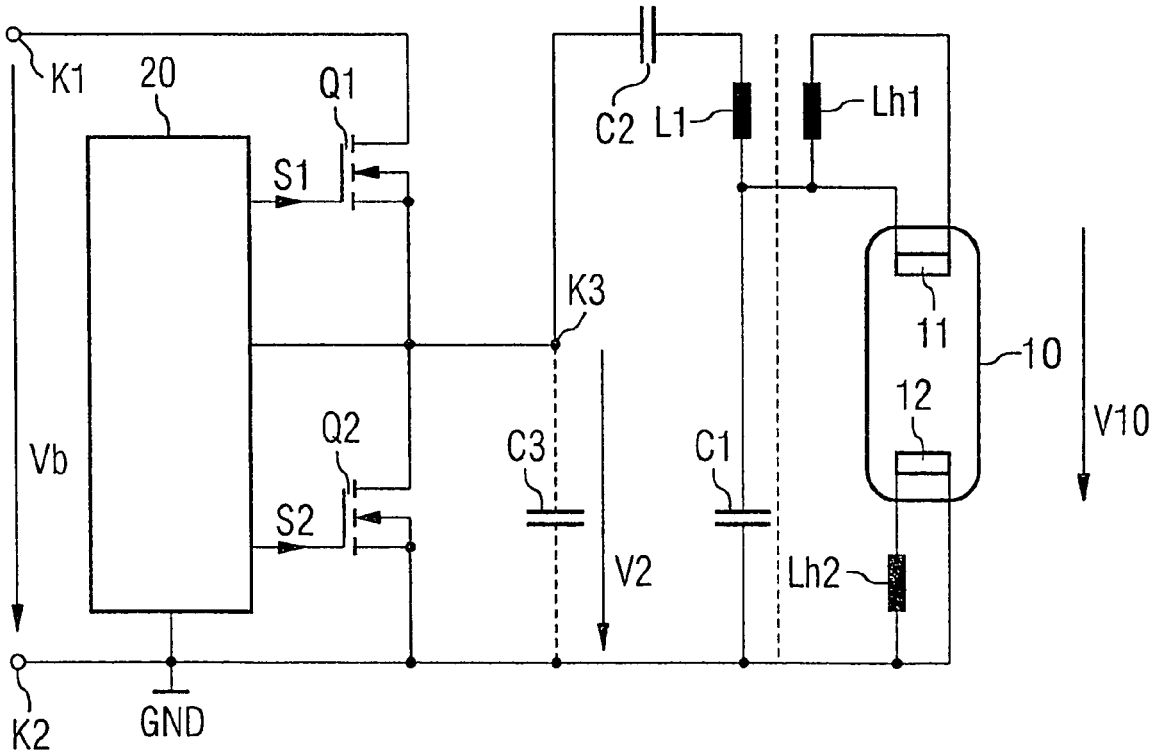
FIG 2 Prior art
FIG. 2 shows a second drive circuit for a fluorescent lamp according to the prior art.
Figure 3:
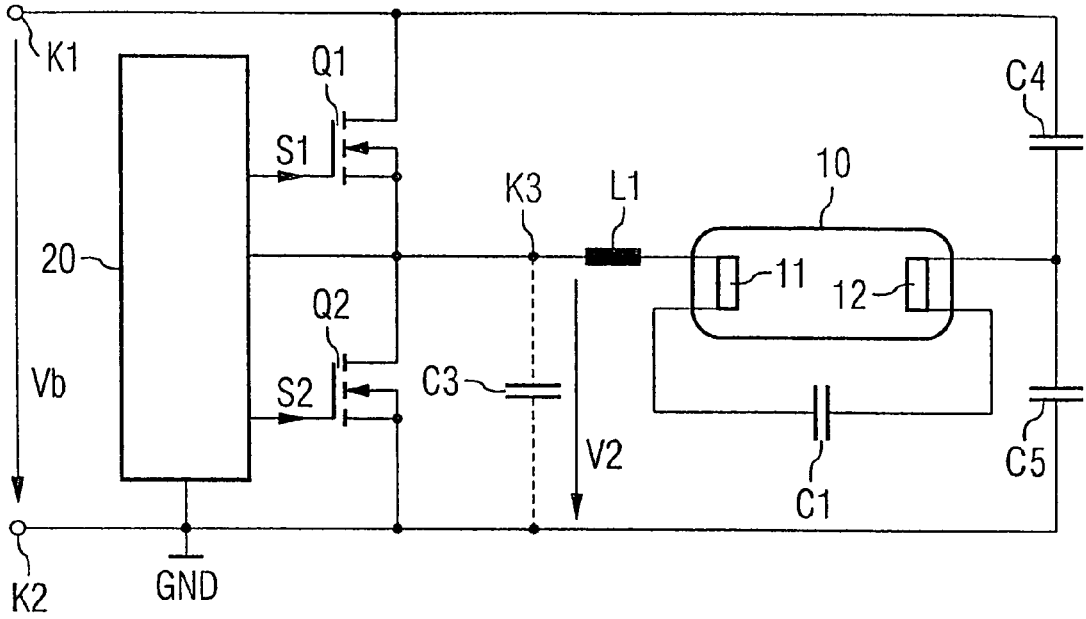
FIG 3 Prior art
FIG. 3 shows a third drive circuit for a fluorescent lamp according to the prior art.
Figure 4:
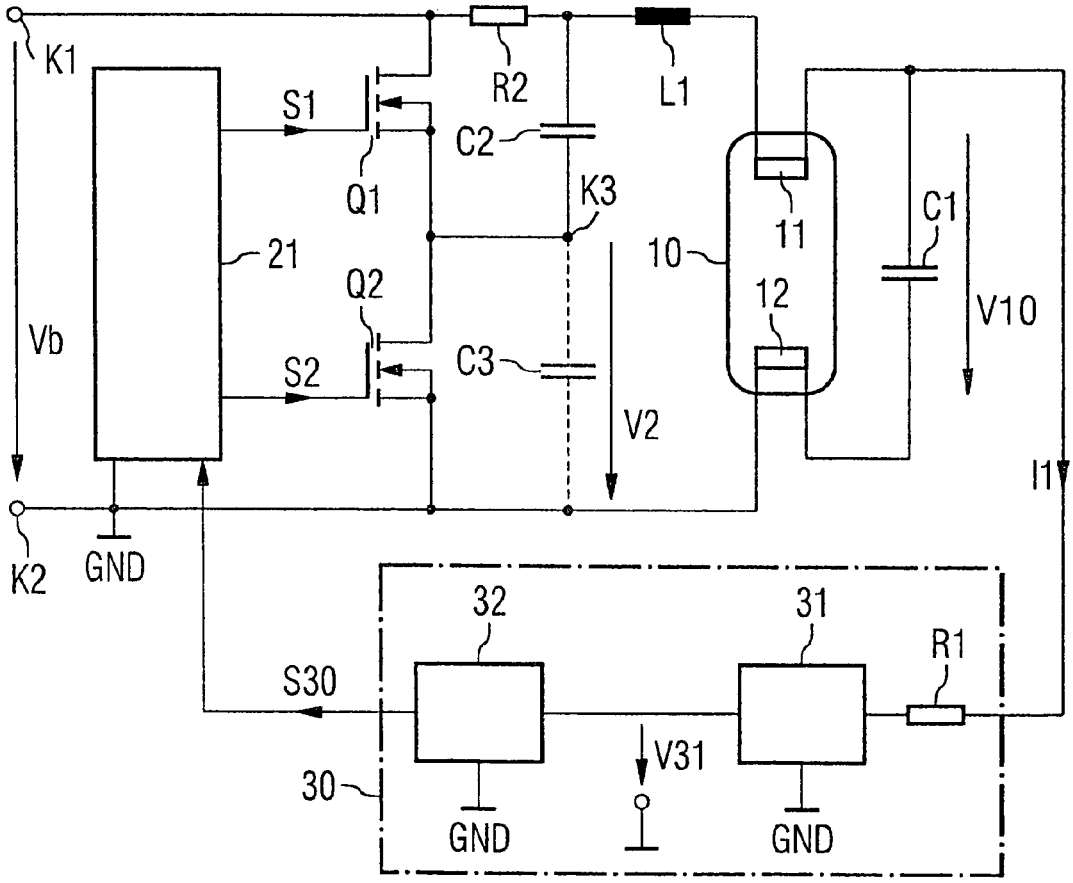
FIG. 4 shows a drive circuit according to the invention for a fluorescent lamp with a diagnosis circuit which has a resistance element, a current/voltage converter and an evaluation circuit.

FIG. 4 shows an exemplary embodiment of a drive circuit according to the invention for a fluorescent lamp 10. This drive circuit has a half-bridge circuit, which has already been explained in the introduction, with a first and a second semiconductor switching element Q1, Q2, whose load paths are connected in series between input terminals K1, K2, to which a DC voltage Vb is applied. A resonant tuned circuit with a resonant inductance L1 and a resonant capacitor C1 is connected to an output K3 of the half-bridge circuit, which is formed by a node that is common to the load paths of the two semiconductor switching elements Q1, Q2. The fluorescent lamp 10 is in this case connected in parallel with the resonant capacitor C1. The fluorescent lamp 10 and the resonant tuned circuit L1, C1 are connected in the example in a corresponding manner to the known circuit shown in FIG. 1, but can also, of course, be connected in a corresponding manner to the circuit shown in FIG. 2. That connection of the lamp 10 which is remote from the half-bridge could likewise be connected to the reference ground potential GND via a capacitive voltage divider, in contrast to the illustration shown in FIG. 4.

A blocking capacitor C2 is connected between the resonant tuned circuit L1, C1 and the half-bridge circuit Q1, Q2 and filters out any DC component from the voltage V2 that is produced by the half-bridge circuit Q1, Q2 and has a pulsed signal waveform. A so-called snubber capacitor C3 is optionally connected in parallel with the load path of the second semiconductor switching element Q2 and, in a manner which has been known for a long time, allows zero voltage operation of the two semiconductor switching elements Q1, Q2, that is to say allows each of these two semiconductor switching elements Q1, Q2 to be switched at times at which the voltage across the load path of these two semiconductor switching elements Q1, Q2 is equal to zero. The use of a snubber capacitor such as this has been known for a long time, and has already been described in U.S. Pat. No. 5,973,943, which was explained in the introduction.

A control circuit 21 is provided in order to drive the semiconductor switching elements Q1, Q2 in the half-bridge circuit and produces drive signals S1, S2 for the semiconductor switching elements such that these two semiconductor switching elements Q1, Q2 are driven in a pulsed manner, with a time offset between them. In this case, the two semiconductor switching elements Q1, Q2 are driven in such a way that they are never switched on at the same time, and such that the two semiconductor switching elements Q1, Q2 are preferably switched off for a predetermined time period at the same time during a switching phase. The frequency at which the half-bridge Q1, Q2 is driven in a pulsed manner is dependent on the respective operating state of the fluorescent lamp 10, and is about 40 kHz once the fluorescent lamp is burning. This frequency may be 65 kHz or more during a preheating phase. The duty cycle of the drive signals S1, S2, that is to say the ratio between the times at which they are switched on and the drive period duration is, for example, about 45%.

According to the invention, the described drive circuit has a diagnosis circuit 30 with a resistance element R1, which is connected to the resonant tuned circuit L1, C1, in the example to the resonant capacitor C1. A current/voltage converter 31 is connected to this resistance element R1 and converts a current 11 flowing through the resistance element R1 to at least one voltage measurement signal V31, which is supplied to an evaluation circuit 32, connected downstream from the current/voltage converter 31. This evaluation circuit 32 provides a diagnosis signal S30 which is supplied to the control circuit 21 for the half-bridge circuit. In this case, the control circuit 21 is designed to interrupt the drive to the half-bridge Q1, Q2 and thus the supply to the fluorescent lamp 10 or, if appropriate, not to start it at all if the diagnosis signal S30 indicates a faulty operating state, which will be explained later.

It should be noted that the control circuit 21 and the current/voltage converter 31 as well as the evaluation circuit 32 for the diagnosis circuit 30 may be integrated in a common semiconductor chip. The control circuit 21 and the diagnosis circuit 30 are illustrated as separate blocks in FIG. 4 only to assist understanding.

Furthermore, the control circuit 21 may of course have any desired further functionalities in addition to the functions already explained, by way of example as described for control circuits in the documents explained in the introduction, relating to the prior art.

As is also evident on the basis of the exemplary embodiments which will be explained in the following text, the diagnosis circuit 30 can largely be integrated. Only the resistance element R1 is an external component, which cannot be integrated in a semiconductor chip.

In the drive circuit according to the invention, a current I1 flowing through the resistance element R1 is proportional to a lamp voltage V10 that is applied across the lamp 10, with the mathematical sign of this current I1 changing with the frequency of the lamp voltage V10, which is approximately sinusoidal once the fluorescent lamp 10 is burning.

The current/voltage converter 31 is designed to produce at least one unipolar measurement voltage V31, which is related to a reference ground potential GND, that is to say a measurement voltage V31 which is either exclusively positive or is exclusively negative, from this current I1 with a changing mathematical sign, the amplitude of which measurement voltage V31 varies corresponding to the amplitude of the measurement current I1 flowing through the resistance element R1.

Figure 6:
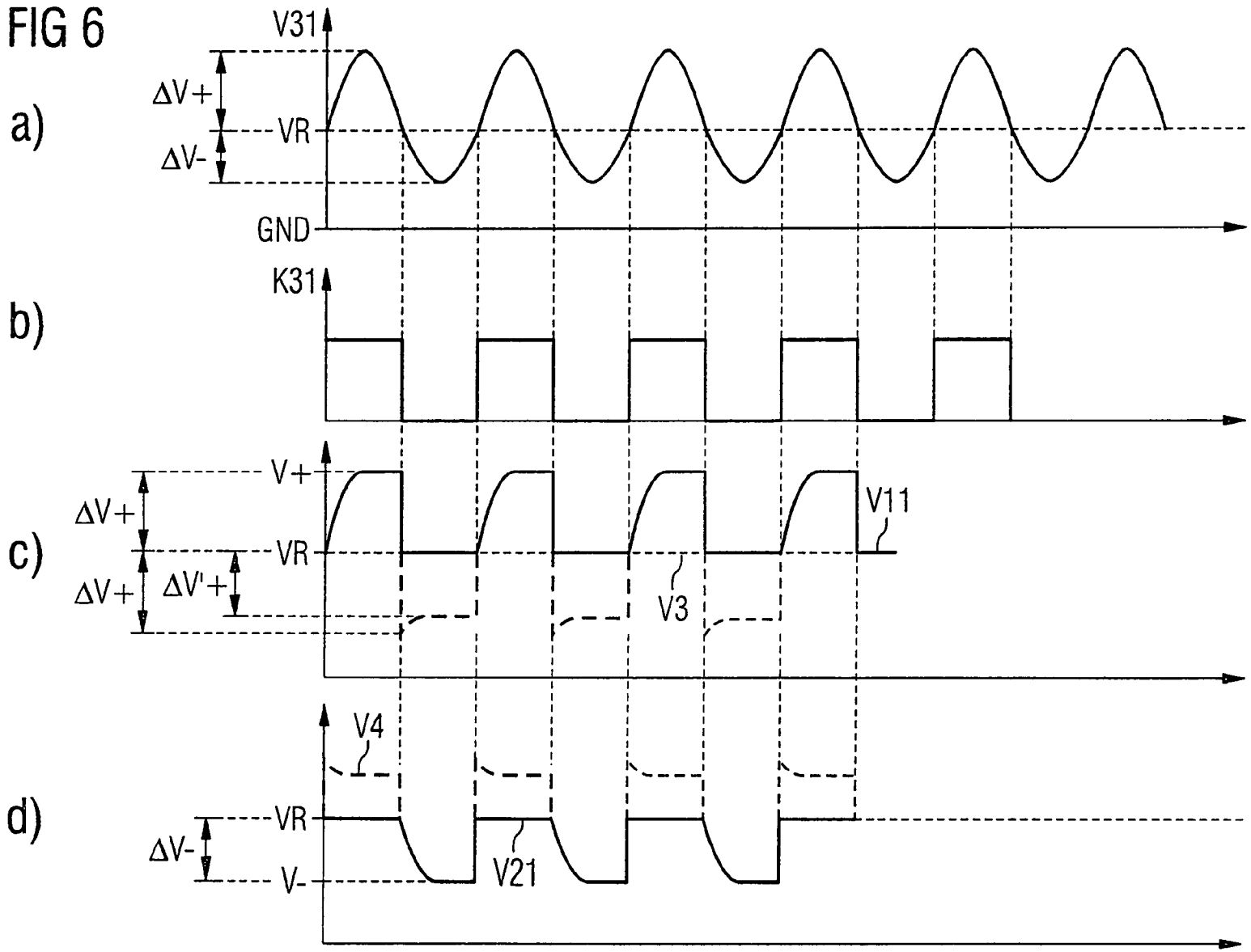
FIG. 6 shows waveforms of selected signals which occur in the evaluation circuit shown in FIG. 5.

With reference to FIG. 6*a*, by way of example, this current/voltage converter 31 is designed to produce a positive measurement voltage V31, which has an AC voltage component, which is proportional to the measurement current I1 or to the lamp voltage V10, and which has a positive DC component or offset VR with respect to the reference ground potential GND. The offset value VR is in this case just reached by the measurement signal V31 when the lamp voltage V10 is zero, or when the measurement current I1 is zero.

In order to produce the measurement signal V31, the offset VR is, by way of example, supplied as a DC voltage from a reference voltage source to the current/voltage converter, which forms the measurement signal V31 by addition of the reference voltage and of a voltage value which is proportional to the measurement current I1.

Figure 5:
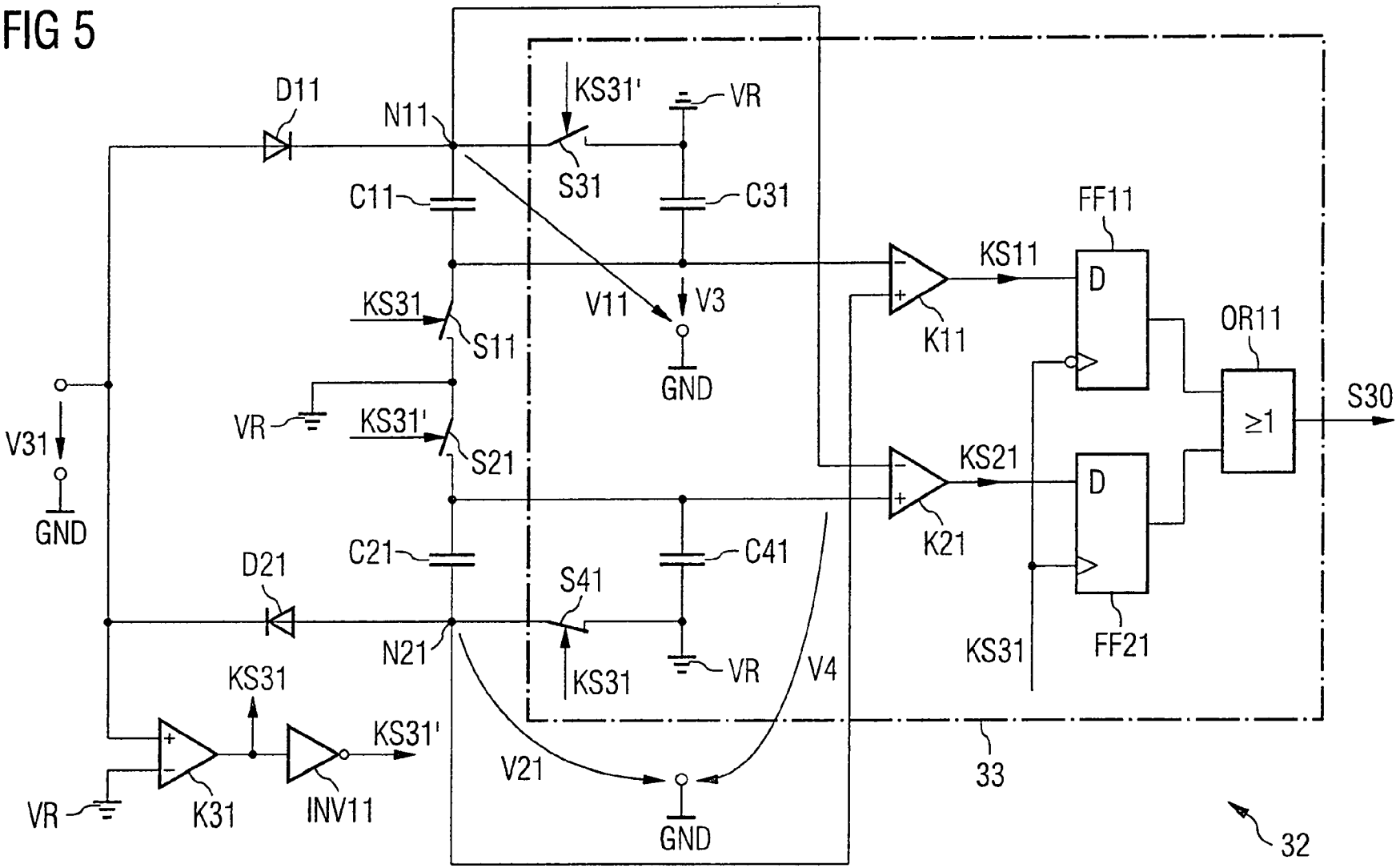
FIG. 5 shows a first exemplary embodiment of an evaluation circuit which produces a wear signal.

FIG. 5 shows a first exemplary embodiment of an evaluation circuit which is used to diagnose possible wear of the fluorescent lamp 10 on the basis of the measurement signal V31 that is derived from the lamp voltage V10, and to produce a wear signal as the diagnosis signal S30. The diagnosis signal is, for example, a two-value signal, which assumes a first signal level on detection of wear, and a second signal level otherwise.

The evaluation circuit 32 is supplied at one input with the measurement signal V31 which is related to the reference ground potential GND. A signal whose magnitude corresponds to the DC component/offset VR of the voltage measurement signal V31 is also available in the evaluation circuit 32. This signal is applied to a number of nodes, which are annotated with "VR", in the evaluation circuit 32.

The evaluation circuit 32 has a first peak value detector D11, C11 with a first diode D11 and a first capacitive storage element C11, which are connected in series with a first switch S11 between the input and offset potential VR. A first control signal KS31 is provided in order to drive the first switch S11, is produced by a first comparator K31 by comparison of the measurement signal V31 with the offset potential VR, and assumes a high level when the amplitude of the measurement signal V31 is greater than the offset potential VR. A second control signal KS31', which is complementary to this first comparison signal K31, is produced from the first control signal K31 by means of an inverter INV11. The waveform of the first comparison signal K31 is illustrated in FIG. 6*b*, for the measurement signal V31 that is illustrated in FIG. 6*a*.

The time periods during which the voltage signal V31 is greater than the offset VR are referred to in the following text as positive half-cycles of the voltage signal V31, while the time periods during which the voltage signal V31 is less than the offset VR are referred to in the following text as negative half-cycles.

The first capacitive storage element C11 is charged via the first rectifier element D11 during positive half-cycles at the voltage signal V31 when the first switch S11 is closed to a value which corresponds to the positive amplitude $\Delta V+$ of the AC voltage component of the measurement voltage V31 minus the conducting-state voltage of the diode D11. The following explanation treats this conducting-state voltage of the diode D11 as being negligible, so that it is assumed that the capacitor is charged to the positive amplitude ΔV+ during the positive half-cycle. A first comparison signal V11 is applied to a node N11 which is common to the detector element D11 and to the storage capacitance C11, with respect to a reference ground potential GND at the end of the positive half-cycle, which first comparison signal V11 corresponds to the sum of the positive amplitude value ΔV+ and the offset potential, such that:

$$V11=VR+\Delta V+ \quad (1).$$

This first comparison signal is also referred to in the following text as the positive peak value signal since, in addition to the constant additive component VR, it contains the information about the positive amplitude ΔV+. At the end of the positive half-cycle, this signal V11 corresponds to the maximum value of the voltage signal V31. ΔV+ denotes the magnitude of the positive amplitude, and is also referred to in the following text as the positive amplitude value.

The evaluation circuit 32 has a second peak path detector with a second diode D21 and a second storage capacitance C21, which is connected in series with a second switch S21 between a node for the offset potential VR and the input. The second diode D21 is in this case connected in the opposite direction to the first diode D11 in order to charge the second storage capacitance C21—ignoring the conducting-state voltage of the diode D21—during a negative half-cycle of the measurement voltage V31 to a value which corresponds to the negative amplitude ΔV− of the measurement voltage V31. A second comparison signal V21 is applied to a node, which is common to the second diode D21 and to the second capacitive storage element C21, with respect to the reference ground potential GND, for which second comparison signal V21 at the end of the negative half-cycle:

$$V21=VR-\Delta V- \quad (2).$$

This signal is also referred to in the following text as the negative peak value signal. Its amplitude at the end of the negative half-cycle corresponds to the minimum value of the voltage signal V31. ΔV− denotes the magnitude of the negative amplitude, and is also referred to in the following text as the negative amplitude value.

The second switch S21 is driven by the second comparison signal KS31', in order to switch this second switch S21 on during the negative half-cycle of the comparison voltage V31.

The voltage which is present across the first storage capacitance C11 at the end of a positive half-cycle corresponds to the positive amplitude ΔV+ of the AC voltage component of the measurement voltage V31 with respect to the offset potential, and is thus a measure of the lamp voltage V10 during the positive half-cycle. The voltage which is present across the second storage capacitance C21 at the end of the negative half-cycle corresponds to the amplitude ΔV−, which is negative with respect to the offset potential VR, of the AC voltage component of the measurement voltage V31, and is thus a measure of the amplitude of the lamp voltage V10 during the negative half-cycle. In order to compare these amplitude values with one another and in this way to make it possible to diagnose possible wear, the evaluation circuit 32 has an assessment unit 33, which produces the diagnosis signal S30.

This assessment unit 33 is fundamentally designed such that it reduces the voltage ΔV+ across the first capacitive storage element C11 after the end of the positive half-cycle, and compares a reduced voltage ΔV+', which results from this—and which is referred to in the following text as the reduced positive amplitude value—with the voltage ΔV− which occurs across the second capacitive storage element C21 during the negative half-cycle. Furthermore, the assessment unit reduces the voltage ΔV− across the second capacitive storage element C21 after the end of the negative half-cycle, and compares a reduced voltage ΔV−', which results from this—and which is referred to in the following text as the reduced negative amplitude value with the voltage ΔV+ which occurs across the first capacitive storage element C11 during the positive half-cycle. Wear is in this case identified when the positive amplitude value ΔV+ is less than the reduced negative amplitude value ΔV−', or when the negative amplitude value ΔV− is less than the reduced positive amplitude value ΔV+'.

In the exemplary embodiment, the assessment unit 33 has a first additional capacitive storage element C31, which can be connected in parallel with the first capacitive storage element C11 by means of a third switch S31. Those connections of the capacitors C11, C31 which face away from the third switch S31 are short-circuited, and are connected to offset potential VR via the first switch S11. The third switch S31 is driven by the second control signal KS31' in order to connect the first additional capacitor C31 in parallel with the first capacitive storage element C11 during the negative half-cycle, with the first switch S11 being open during this time period.

In a corresponding manner, the assessment unit 33 has a second additional capacitive storage element C41, which can be connected in parallel with the second storage capacitance C21 by means of a fourth switch S41. Those connections of the capacitors C21, C41 which face away from the fourth switch are short-circuited, and are connected to the offset potential VR via the second switch. The fourth switch S41 is driven by the first comparison signal KS31 in order to short-circuit the second capacitive storage element C21 and the second further capacitive storage element C41 during the positive half-cycles of the measurement voltage V31. The second switch S21 is open during these half-cycles.

The method of operation of the assessment unit 33 will be explained in the following text with reference to the waveforms shown in FIGS. 6*c* and 6*d*. In this case, FIG. 6*c* shows the waveforms of the first peak potential V11 at the node N11, which is common to the diode D11 and the capacitive storage element C11, of the first peak value detector and of a first comparison potential V31 at the node which is common to the first capacitor C11 and the first further capacitor C31. FIG. 6*d* shows the waveform of the second peak potential V21 at the node which is common to the diode D21 and the capacitive storage element C21 of the second peak value detector, and of the second comparison potential V4 at the node which is common to the second capacitive storage element C21 and the second further capacitive storage element C41.

With reference to FIGS. 5 and 6*c*, the potential V11 at the first peak value detector D11, C11 rises during the positive half-cycles when the first switch S11 is closed and the third switch S31 is open to the maximum value of the comparison voltage V3, which corresponds to the sum of the offset potential VR and the positive amplitude value ΔV+. The first further capacitive storage element C31 is connected between the two connections for the offset potential VR during this positive half-cycle, so that this capacitive storage element C31 is discharged.

At the start of the negative half-cycle, the first switch S11 is opened, and the third switch S31 is closed. This leads to the first capacitive storage element C11 being partially discharge. Assuming that the magnitude of the voltage across the first capacitive storage element C11 at the end of the positive half-cycle corresponds to the magnitude of the positive amplitude ΔV+, the reduced positive amplitude value ΔV+' is produced across the parallel circuit from the two capacitive storage elements C11, C31 after closing of the third switch S31 and after exchange of charge has occurred, for which:

$$\Delta V+'=C11/(C11+C31)\cdot\Delta V+=k1\cdot\Delta V+ \quad (3).$$

The reduced positive amplitude value ΔV+' thus results from the positive amplitude ΔV+ by multiplication by a factor k1<1.

In order to make it possible to compare this reduced positive amplitude value ΔV+' with the negative amplitude value ΔV−, a third comparison signal V3 is produced, for which:

$$V3=VR-\Delta V+' \quad (4).$$

After the opening of the first switch S11 and the closing of the third switch S31, as a result of which the node N11 of the first peak value detector is at the offset potential VR, this signal V3 is produced between the node which is common to the capacitors C11, C31 and the reference ground potential GND. The waveform of this third comparison signal V3 is shown by dashed lines in FIG. 6*c*. During the positive half-cycle, when the first switch S11 is closed, this comparison signal V3 corresponds to the offset potential VR.

After the first switch S11 has been opened and the third switch S31 has been closed, this third comparison signal V3 first of all falls to a value which corresponds to the offset potential VR minus the positive amplitude value ΔV+, with the comparison signal V3 rising to the value indicated in (4) owing to the discharging of the first storage capacitance C11 as the negative half-cycle progresses further.

The comparison of the negative amplitude value ΔV− with the reduced positive amplitude value ΔV+' is carried out by means of a first comparator K11, which compares the second comparison signal or the negative peak value signal V21=VR−ΔV− with the third comparison signal V3=VR−ΔV+'. A comparison of these two signals, which each have the magnitudes ΔV+' and ΔV− with a negative mathematical sign and an additive component VR, which is in each case the same, makes it possible to draw a direct conclusion relating to the ratio between the negative signal value ΔV− and the reduced positive signal value ΔV+'. If the second comparison value V21 is greater than the third comparison value V3, then the negative amplitude value ΔV− is less than the reduced positive amplitude value ΔV+', which is interpreted as a fault. The output signal KS11 from the first comparator K11 then assumes a high level, which is stored in a first flipflop FF11 at the end of the negative half-cycle, with a high level that results from this at the output of the first flipflop FF11 leading via an OR gate OR11 to a high level of the wear signal S30 that is produced at the output. The wear signal thus assumes a high level when the positive amplitude value ΔV+ of the AC component of the signal V31 is greater than the negative amplitude value ΔV− by more than a factor (C11+C31)/C11.

The second capacitive storage element C21 is charged during the negative half-cycle of the comparison voltage V3 to a voltage which corresponds to the negative amplitude ΔV− of the AC component of the voltage signal V31.

At the start of the positive half-cycle, the second switch S21 is opened, and the fourth switch S41 is closed. This leads to the second capacitive storage element C21 being partially discharged. Assuming that the magnitude of the voltage across the second capacitive storage element C21 at the end of the negative half-cycle corresponds to the magnitude of the negative amplitude ΔV−, the reduced negative amplitude value ΔV−' is produced after closing of the fourth switch S41 and the subsequent charge exchange across the parallel circuit formed by the two capacitive storage elements C21, C41, for which negative amplitude value ΔV−':

$$\Delta V-'=C21/(C21+C41)\cdot\Delta V-=k2\cdot\Delta V- \quad (5).$$

The reduced negative value ΔV−' thus results from the negative amplitude ΔV− by multiplication by a factor k2 <1.

In order to make it possible to compare this reduced negative amplitude value ΔV−' with the positive amplitude value ΔV+, a fourth comparison signal V4 is produced, for which:

$$V4=VR+\Delta V-' \quad (6).$$

After opening of the second switch S21 and closing of the fourth switch S41, as a result of which the node N21 of the second peak value detector is at the offset potential VR, this signal V4 is produced between the node which is common to the capacitors C21, C41 and the reference ground potential GND. The waveform of this fourth comparison signal V4 is represented by dashed lines in FIG. 6*d*. During the negative half-cycle, when the second switch S21 is closed, this comparison signal V4 corresponds to the offset potential VR.

After the opening of the second switch S21 and the closing of the fourth switch S41, this fourth comparison signal V4 initially rises to a value which corresponds to the offset potential VR plus the negative amplitude value ΔV−, with the comparison signal V4 falling to the value indicated in (6) as a result of the discharging of the second storage capacitance C21 as the positive half-cycle progresses further.

The comparison of the positive amplitude value ΔV+ with the reduced negative amplitude value ΔV−' is carried out by means of a second comparator K21, which compares the first comparison signal or the positive peak value signal V11=VR+ΔV+ with the fourth comparison signal V4=VR+ΔV−'. A comparison of these two signals, which respectively have the magnitudes ΔV+' and ΔV− with a positive mathematical sign, and an additive component VR which is in each case the same makes it possible to draw a direct conclusion on the ratio between the positive signal value ΔV+ and the reduced negative signal value ΔV−'. If the fourth comparison value V4 is greater than the first comparison value V11, then the positive amplitude value ΔV+ is less than the reduced negative amplitude value ΔV−', which is interpreted as a fault. The output signal KS21 then the second comparator K21 then assumes a high level, which is stored in a second flipflop FF21 at the end of the positive half-cycle, with a high level which results from it at the output of the second flipflop FF21 leading via the OR gate OR11 to a high level of the wear signal S30 which is produced at the output. The wear signal thus assumes a high level when the negative amplitude value ΔV− of the AC component of the signal V31 is greater than the positive amplitude value ΔV+by more than a factor (C21+C41)/C21.

In the evaluation circuit 32 illustrated in FIG. 5, the voltage which is present across the first capacitive storage element C11 at the end of the positive half-cycle does not correspond entirely to the positive amplitude ΔV+, but is reduced in comparison to this amplitude by the value of the conducting-state voltage of the first diode D11. In a corresponding manner, the voltage across the second capacitive storage element C21 at the end of the negative half-cycle does not correspond entirely to the negative amplitude ΔV−, but is reduced by the magnitude of the conducting-state voltage of the second diode D21 in comparison to the magnitude of this negative amplitude ΔV−.

Figure 7:
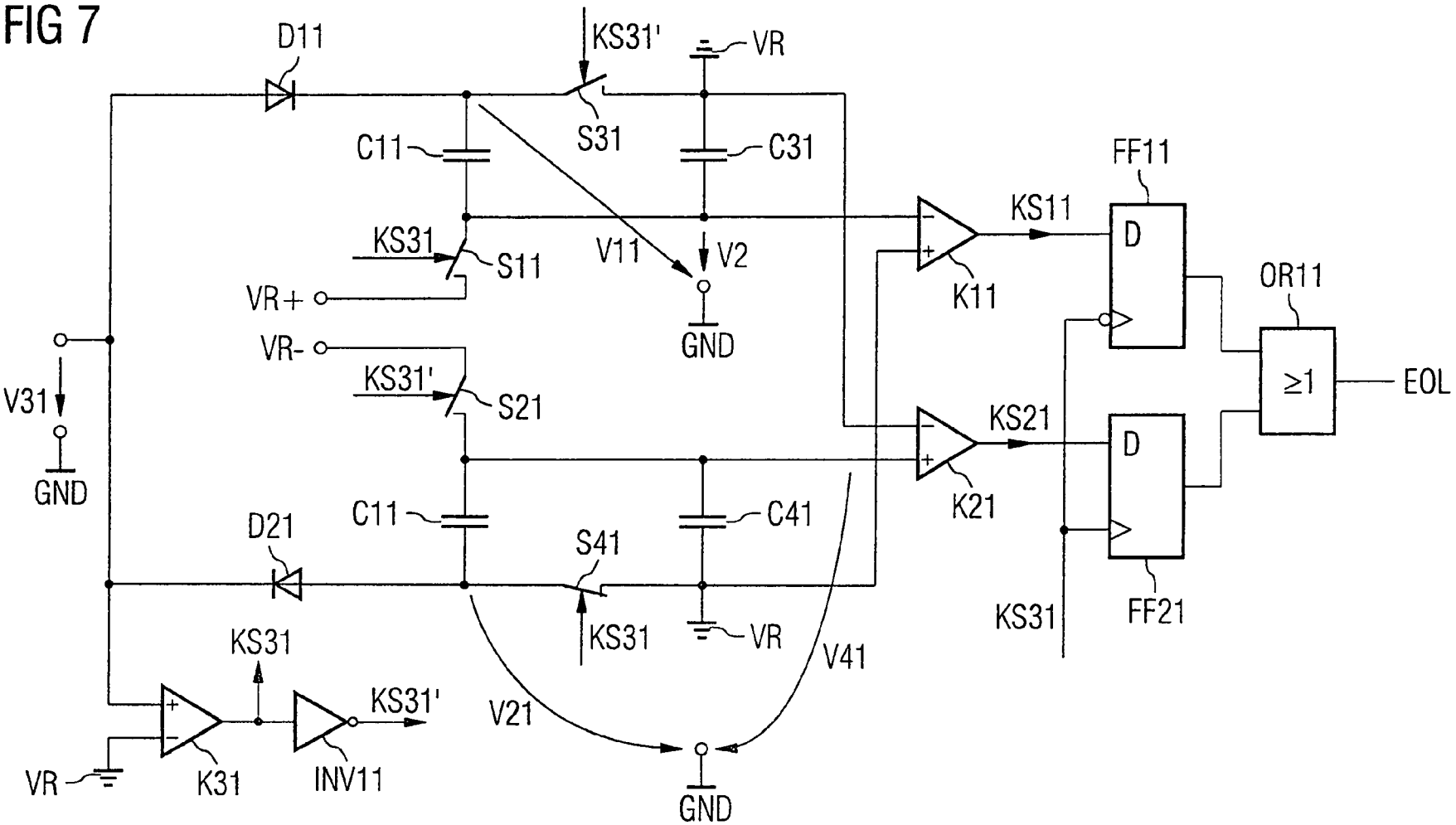
FIG. 7 shows a modification of the evaluation circuit shown in FIG. 5.

FIG. 7 shows a modification of the evaluation circuit 32 as shown in FIG. 5, in which this problem is avoided. In this evaluation circuit, the first capacitive storage element C11 is connected via the first switch S11 to an increased offset potential VR+, which is greater than the offset potential by a fraction of a diode voltage. The reason for this will be described briefly in the following text:

To a first approximation, the diode voltages of D11 and D21 cancel one another out when compared at the inputs of the comparators K11 and K21. To a second approximation, however, this results in an error because, for example, the diode voltage from D21 is produced weighted by the factor 1 at the input of K11, while the diode voltage of D11 is produced at the comparator input weighted by the factor C11/(C11+C31). C11 is thus charged to a voltage which is reduced by a fraction of a diode voltage, that is to say VR+ must be somewhat greater than VR.

Furthermore, the second capacitive storage element C21 in this exemplary embodiment is connected via the second switch S21 to a reduced offset potential VR−, which is less than the offset potential VR by a fraction of a diode voltage.

Figure 8:
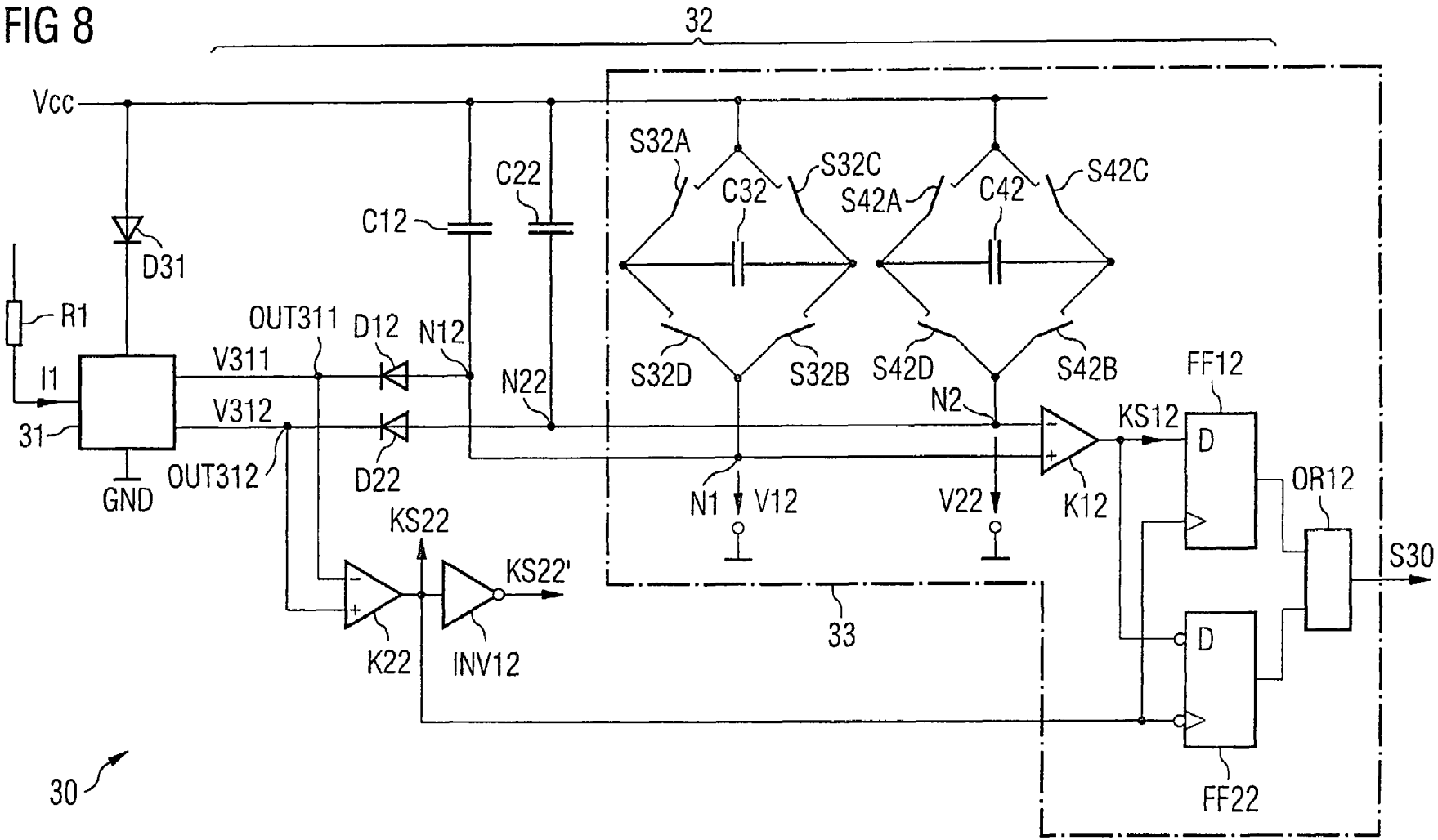
FIG. 8 shows a diagnosis circuit with an evaluation circuit according to a second exemplary embodiment.

FIG. 8 shows a further exemplary embodiment of the diagnosis circuit according to the invention. This diagnosis circuit has a current/voltage converter 31 which produces two voltages V311, V312, one of which in each case represents the positive half-cycle of the measurement current I1 or the lamp voltage V10, and one of which in each case represents the negative half-cycle of the measurement current I1 or the lamp voltage V10. This current/voltage converter 31 is designed with respect to the waveforms shown in FIGS. 9*a* to 9*c* to produce the first voltage signal V311 such that it assumes a predetermined offset value VR2 during negative half-cycles of the measurement current I1, and such that it falls below this offset value VR2 during positive half-cycles of the measurement current I1, with the waveform of the first voltage signal V311 being linearly dependent during the positive half-cycle on the positive half-cycle of the measurement current I1 multiplied by the factor −1.

The second voltage measurement signal V312 is produced by the current/voltage converter such that the second voltage signal V312 assumes the offset value VR2 during the positive half-cycle of the measurement current I1, and such that this voltage signal V312 is linearly dependent during the negative half-cycle on a measurement current I2 that has been shifted by the offset VR2.

Figure 9:
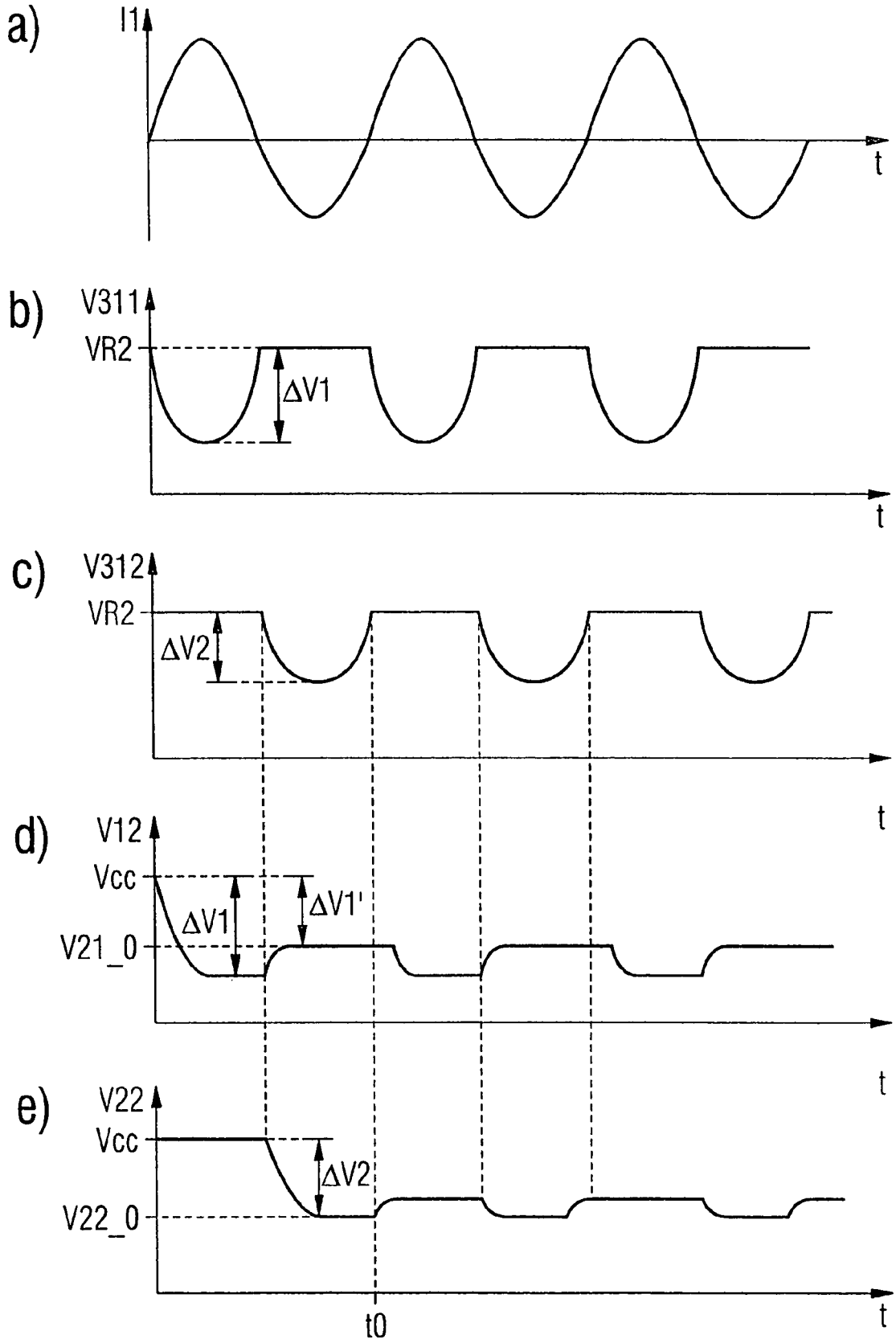
FIG. 9 shows waveforms of selected signals which occur in the evaluation circuit shown in FIG. 8.
Figure 10:
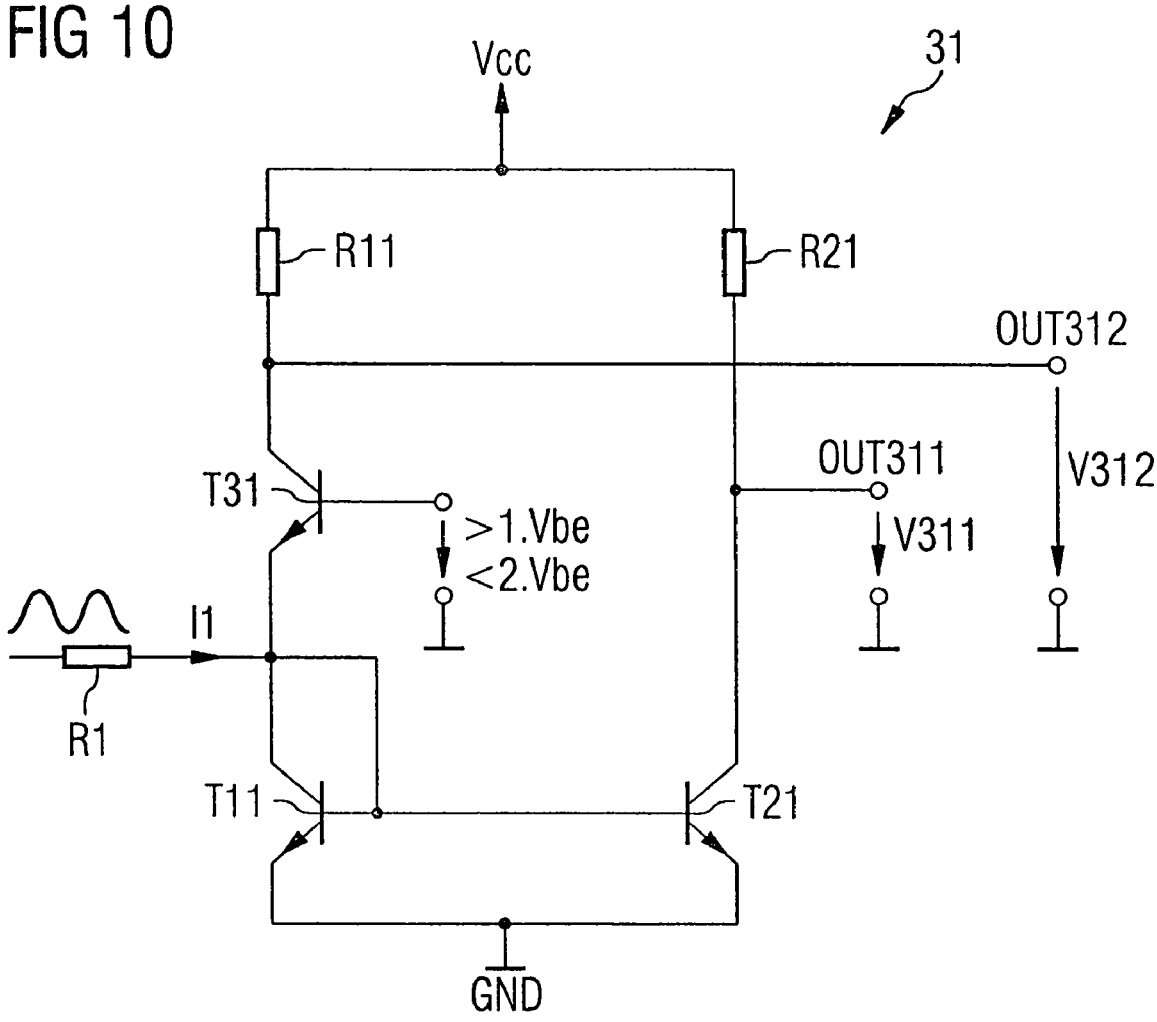
FIG. 10 shows an implementation example of a current/voltage converter.

FIG. 10 illustrates a circuitry implementation example of a current/voltage converter which produces measurement voltages V311, V312, as shown in FIGS. 9*b* and 9*c*, from the measurement current I1. This current/voltage converter has an inverter, which has a resistor R21, a transistor T21 connected in series with the resistor R21, and a transistor T11 connected as a diode. The first voltage V311 can in this case be tapped off with respect to the reference ground potential GND at a node which is common to the load path of the transistor T21 and the resistor R21. The transistors T21 and T11 in the exemplary embodiment are in the form of npn bipolar transistors and are connected to form a balanced circuit, whose input is driven by the measurement current I1. During the positive half-cycle of the measurement current I1, the transistor T21 becomes more conductive as the measurement current I1 increases, so that the measurement voltage V311 decreases as the positive measurement current I1 increases.

The current/voltage converter also has a series circuit with a further resistor R11 and a further transistor T31. In this exemplary embodiment, the measurement I1 is injected at the emitter of the further transistor T31. The further transistor T31 is permanently biased by a drive voltage which is between the threshold voltage Vbe and twice the threshold voltage Vbe of the further bipolar transistor T31. This ensures that this further transistor T31 is switched off during a positive half-cycle of the measurement current I1. During a negative half-cycle of the measurement current I1, the emitter potential of the further transistor T31 falls, so that this transistor starts to conduct. The bias voltage means that the emitter potential of the further transistor T31 cannot fall to values below the reference ground potential GND. The second measurement signal V312 essentially follows the measurement current I1 during the negative half-cycle of the measurement current I1.

It should be noted that MOS transistors may, of course, also be used instead of the bipolar transistors illustrated in FIG. 10.

The evaluation circuit 32 in the exemplary embodiment of the diagnosis circuit shown in FIG. 8 has a first peak value detector with a first capacitive storage element C12 and a first detector element D12, which are connected in series between a positive supply potential of Vcc and a first output OUT311 of the current/voltage converter, at which the first voltage signal V311 is produced. In a corresponding manner, a second peak value detector is provided with a second capacitive storage element C22 and a second detector element D22, which are connected in series between the positive supply potential of Vcc and a second output OUT312 of the current/voltage converter 31, at which the second voltage signal V312 can be tapped off.

An assessment unit 33 in the example has a first additional capacitive storage element C32 which can be connected in parallel with the first capacitive storage element C12 by means of a first switch arrangement S32A-S32D. The assessment unit 33 also has a second additional capacitive storage element C42, which can be connected in parallel with the second capacitive storage element C22 by means of a second switch arrangement S42A-S42D. The switch arrangements S32A-S32D and S42A-S42D are in each case designed such that the additional capacitive storage elements C32, C42 and the switch arrangements S32A-S32D and S42A-S42D, respectively, each form a bridge circuit, so that the capacitive storage elements C32, C42 can be selectively connected in a first polarity direction or in a second polarity direction in parallel with the capacitive storage elements C12, C22. Polarity reversal of the further capacitive storage elements C32, C42 is in this case always carried out after one half-cycle of the measurement current I1. With respect to the first switch arrangement, this means that the switches S32A, S32B are switched on during one half-cycle, while the switches S32C, S32D are switched off, and that the two switches S21A, S32B are switched off during a next half-cycle, while the two other switches S32C, S32D are switched on. In a corresponding manner, the switches S42A, S42B are jointly switched on by the second switch arrangement during one half-cycle, while the switches S42C, S42D are switched on, and the two other switches S42A, S42B are switched off, during the next half-cycle.

The switches in the two switch arrangements S32A-S32D and S42A-S42D are switched as a function of control signals S22, S22' which are produced by comparison of the voltage measurement signals V311, V312 by means of a comparator K22. A first control signal KS22 in this case corresponds to the output signal from the comparator, and the second control signal KS22' corresponds to the output signal from the comparator K22, inverted by means of an inverter INV11. In the exemplary embodiment, the first control signal KS22 assumes a high level during the positive half-cycles of the measurement current I1 and during the positive half-cycles of the lamp voltage V10, and assumes a low level during the negative half-cycles. Respectively opposite switches in the switch bridge arrangements S32A-S32D and S42A-S42D, that is to say the switches S32A, S32B in the first switch arrangement and S42A, S42B in the second switch arrangement, are driven, for example, by the first control signal KS22, while the other opposite switches, that is to say the switches S32C, S32D in the first switch arrangement and S42C, S42D in the second switch arrangement, are driven by the second control signal KS22'.

The method of operation of the evaluation circuit 32 as shown in FIG. 8 will be explained in more detail in the following text with reference to the waveforms shown in FIG. 9. FIG. 9*d* shows the waveform of a potential V12 at a common node N12 in the first capacitive storage element C12, and in the first detector element D12 of the first peak value detector. During the positive half-cycle of the measurement current I1, this potential V12 is drawn to a value which corresponds to the minimum value of the first voltage signal V311 with respect to the reference ground potential GND. This minimum value of the first voltage signal V311 during the positive half-cycle corresponds to the offset value VR2 minus an amplitude value ΔV1 which is proportional to the positive amplitude of the measurement current I1. In the example, the offset value VR2 corresponds to the positive supply voltage Vcc minus a diode voltage of the first diode D21. A further diode, which is connected between the supply potential Vcc and the current/voltage converter, provides compensation for the voltage drop across the diode, so that the maximum value of the voltage which occurs across the parallel circuit formed by the first capacitive storage element C12 and the first further capacitive storage element C32 corresponds to the first amplitude value ΔV1. Thus, at the end of the positive half-cycle:

$$V12=Vcc-\Delta V1 \quad (7).$$

The amplitude value ΔV1 is referred to in the following text as the positive amplitude. V12 is referred to in the following text as the first comparison value.

At the start of the negative half-cycle of the measurement current I1, the polarity of the second capacitive storage element C32 is reversed, thus resulting in the first capacitive storage element C12 being partially discharged, and in the potential V12 at the first node N1 rising. The voltage ΔV1' which is produced after the charge exchange across the parallel circuit formed by the first capacitive storage element C1 and the second further capacitive storage element C32, and which is referred to in the following text as the reduced positive amplitude value results from the positive amplitude value ΔV1 during the positive half-cycle in accordance with the following relationship:

$$\Delta V1'=(C12-C32)/(C12+C32)\cdot\Delta V1 \quad (8),$$

so that the potential V12 at the end of the negative half-cycle is:

$$V12=Vcc-\Delta V1' \quad (9).$$

The first further capacitor C32 is in this case selected such that its capacitance is less than that of the first capacitor C12.

During the negative half-cycle of the measurement current I1, a peak voltage ΔV2 is produced across the parallel circuit of the second capacitor C22 and the second further capacitor C42 which is proportional to the negative amplitude of the measurement current I1, and is referred to in the following text as the negative amplitude value. Thus, during the negative half-cycle, a second potential V22 is produced at a node which is common to the second capacitor C22 and the second diode D22, which potential V22 corresponds to the supply potential Vcc minus this second amplitude ΔV2, so that, at the end of the negative half-cycle:

$$V22=Vcc-\Delta V2 \quad (10).$$

The amplitude value ΔV2 is referred to in the following text as the negative amplitude value. V22 is referred to in the following text as the second comparison value.

At the start of a positive half-cycle, the polarity of the second additional capacitive storage element C42 is reversed, so that the voltage which is produced across the parallel circuit formed by the second capacitor C22 and the additional capacitor C42 falls to a value ΔV2' for which, at the end of the positive half-cycle:

$$\Delta V2'=(C22-C42)/(C22+C42)\cdot\Delta V2. \quad (11).$$

This value ΔV2' is referred to in the following text as the reduced negative amplitude value.

The second comparison value V22 at the end of the positive half-cycle is then:

$$V22=Vcc-\Delta V2' \quad (12)$$

The second further capacitor C42 is in this case selected such that its capacitance is less than that of the second capacitor C22.

In order to determine wear, the positive amplitude value ΔV1 is compared with the reduced negative amplitude value ΔV2', and the negative amplitude value ΔV2 is compared with the reduced positive amplitude value ΔV1', with wear being assumed when the respective reduced value ΔV1' or ΔV2' is greater than the respective peak value ΔV2 or ΔV1.

For this comparison, the first and second comparison signals V12, V22 are compared by means of a comparator K12. An output signal from the comparator is in this case stored in a first flipflop FF12 at the end of the positive half-cycle, and is stored in an inverted form in a second flipflop FF22 at the end of the negative half-cycle, with the output signals in the flip-flops FF12, FF2 being supplied to an OR gate OR12, at whose output the wear signal S30 is produced.

If the first comparison value V12 at the end of the positive half-cycle is greater than the second comparison value V22, then, taking into account (7) and (12) as well as (11), this means that:

$$Vcc-\Delta V1>Vcc-\Delta V2'\Rightarrow$$

$$\Delta V1<(C22-C42)/(C22+C42)\cdot\Delta V2\Rightarrow$$

$$\Delta V1<k3\cdot\Delta V2 \quad (13)$$

In this case, a high level is produced at the output of the comparator K12 at the end of the positive half-cycle, and this is stored in the first flipflop FF12 and leads to the wear signal S30 having a high level.

If the second comparison value V22 at the end of the negative half-cycle is greater than the first comparison value V12, then this means, taking into account (9) and (10) as well as (8), that:

$$Vcc-\Delta V2>Vcc-\Delta V1' \Rightarrow$$

$$\Delta V2<(C12-C32)/(C12+C32)\cdot\Delta V1 \Rightarrow$$

$$\Delta V1<k4\cdot\Delta V2 \quad (14)$$

In this case, a low level is produced at the output of the comparator K12 at the end of the negative half-cycle, which is inverted and is stored as a high level in the second flipflop FF22, and leads to the wear signal S30 having a high level.

In both cases, the high level of the wear signal is thus produced when the respective amplitude ΔV1 or ΔV2 during one half-cycle is less by a factor k3, k4, which is less than 1, than the amplitude during the respective other half-cycle. The capacitances C12, C22, C32, C42 are in this case preferably selected such that the factors k3, k4 are in each case the same.

In summary, in this exemplary embodiment as well, one capacitor is charged during one half-cycle with a voltage which is proportional to the maximum amplitude of a voltage measurement signal V311, V312 during this half-cycle. During the next half-cycle, the capacitor is partially discharged, and the comparison value which results from it is compared with the peak voltage occurring during this half-cycle across the other capacitor, in order to use this to generate a diagnosis signal which indicates possible wear of the lamp. In the exemplary embodiment shown in FIG. 8, this diagnosis signal S30 assumes a high level when such wear is detected, that is to say when the first amplitude ΔV1 of the signal component which is proportional to the measurement current of the first voltage measurement signal V311 is greater by more than a predetermined factor than the second amplitude ΔV2, or when this second amplitude ΔV2 of the signal component which is proportional to the measurement current of the second voltage measurement signal V312 is greater by more than a predetermined factor than the first amplitude ΔV1. These factors are in this case dependent, in the manner explained above, on the ratio of the respective parallel-connected capacitors C12, C32 and C22, C42.

Figure 11:
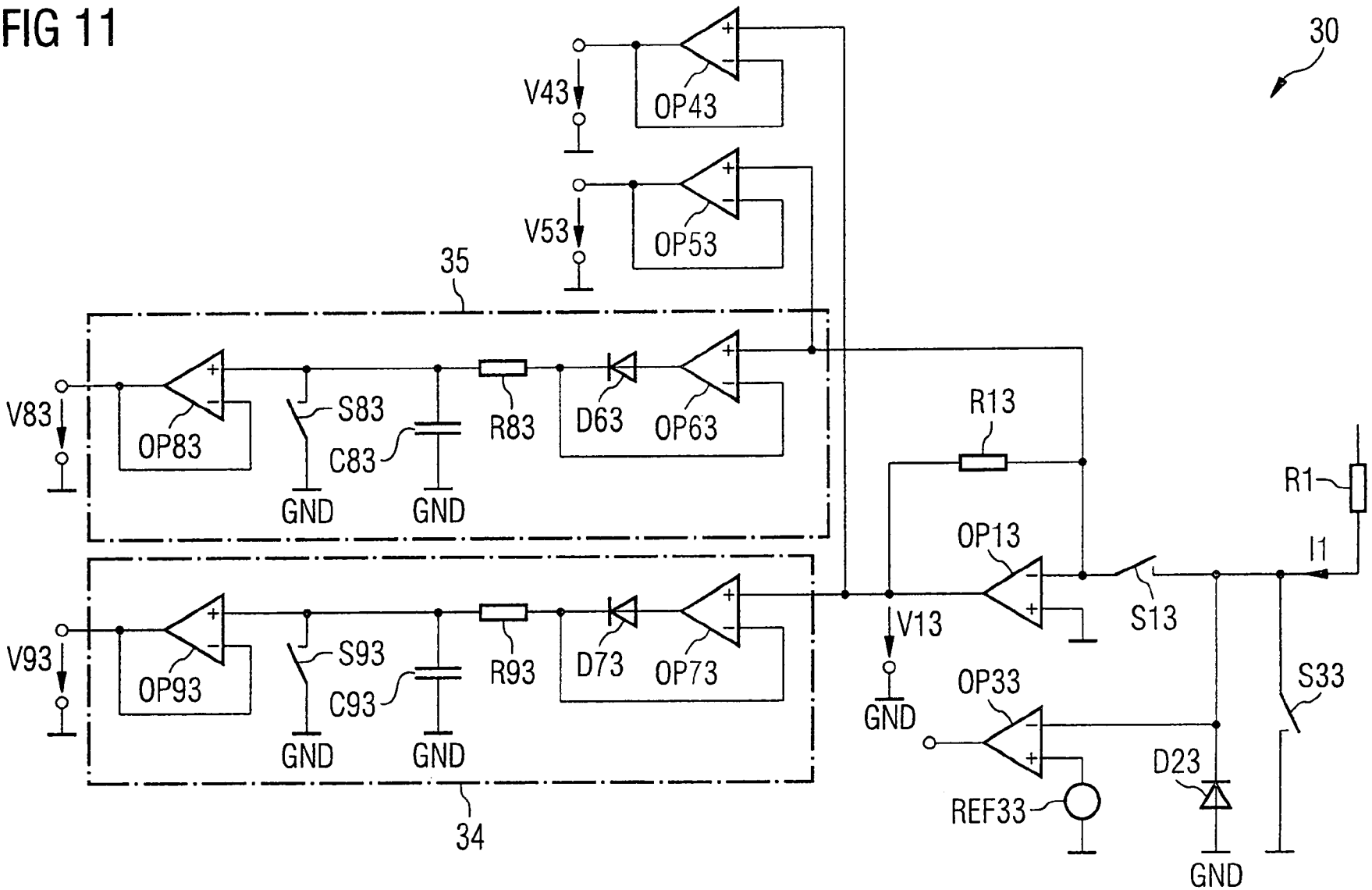
FIG. 11 shows a further implementation example of a diagnosis circuit.

A further exemplary embodiment of a diagnosis circuit according to the invention is illustrated in FIG. 11. This diagnosis circuit has a number of current/voltage converter units, which each produce positive output voltages V43, V53, V83, V93, which are either proportional to the instantaneous value of the input current I1 during one half-cycle or are proportional to the maximum value of the amplitude of the input current I1 during one half-cycle.

Figure 12:
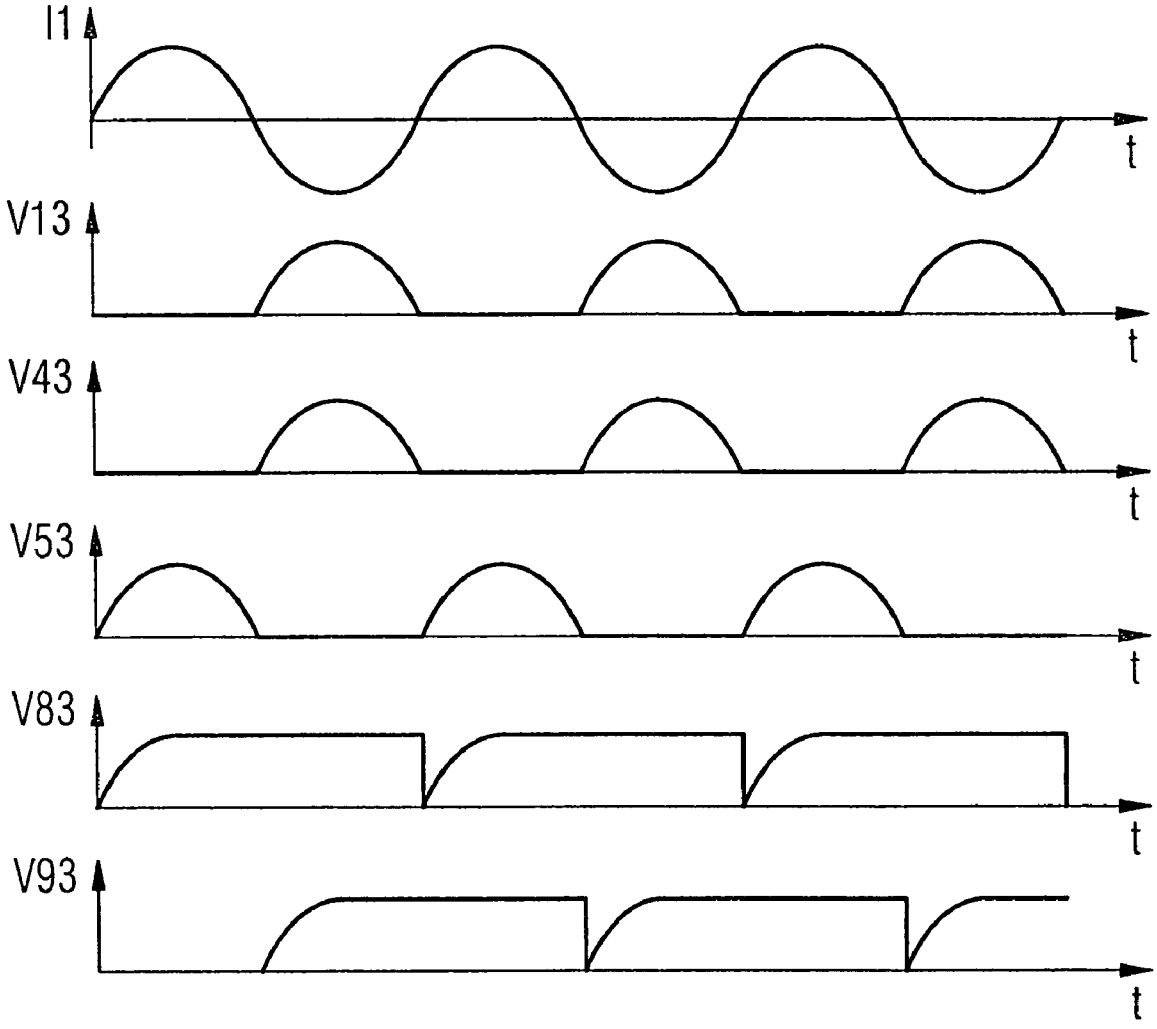
FIG. 12 shows waveforms of selected signals which occur in the diagnosis circuit shown in FIG. 11.

In this diagnosis circuit, the measurement current I1 is supplied directly to an inverting input converter, which has an operational amplifier OP13 and a resistor R13 which is connected between the negative input and the output of the operational amplifier OP13. A voltage V13 with respect to the reference ground potential GND is produced at the output of this operational amplifier OP13, whose waveform is illustrated in FIG. 12 in comparison to the waveform of the input current I1. This voltage V13 is zero during positive half-cycles of the input current I1, and assumes a positive value during negative half-cycles of the input current I1, with the signal value being proportional to the signal value of the input current I1, multiplied by −1, during the negative half-cycle. This input converter OP13, R13 thus carries out the function of an inverting half-wave rectifier.

The output signal from this input converter is supplied to an instantaneous value output stage OP43, which has an operational amplifier whose positive input is supplied with the voltage V13, and at whose output an instantaneous value signal V43 is produced, which is zero during positive half-cycles of the input current I1, and which has positive values during negative half-cycles of this input current I1, which positive values are proportional to the input current I1, multiplied by −1, during the negative half-cycles.

Furthermore, a second instantaneous value output stage OP53 is provided, which has an operational amplifier OP53 whose positive input is supplied with the input current I1, and whose negative input is coupled to its output. A second instantaneous value voltage V53 is produced at the output of this second instantaneous value output stage OP53, which is zero during the negative half-cycle of the input current I1 and is proportional to the input current I1 during the positive half-cycle.

The diagnosis circuit 32 also has first and second peak value detectors 34, 35, with the first peak value detector 34 being supplied directly with the input current I1, and with the second peak value detector being supplied with the output signal V13 from the half-wave rectifier OP13, R13. The two peak value detectors 34, 35 have a respective input amplifier OP63, OP73, to which the respective input signal I1 or V13 is supplied at its positive input, and whose outputs are followed by a respective diode D63, D73. The cathode connection of the diode D63, D73 is in this case fed back to the negative input of the operational amplifier OP63, OP73. The operational amplifier OP63, OP73 with the downstream diode D63, D73 results in a peak value detection, so that a value is in each case produced at the cathode connection of the diode D63 of the first detector 34 at the end of the positive half-cycle which is proportional to the maximum value of the measurement current I1 during the positive half-cycle. At the end of the negative half-cycle, a positive voltage which is proportional to the amplitude of the measurement current I1 during the negative half-cycle is produced at the cathode connection of the diode D73 of the second detector 35.

A capacitor C83, C93, which is used as a hold element, is in each case connected downstream from the diodes D63, D73 in the two peak value detector units 34, 35, via a respective resistor R83, R93. A voltage which is produced across these capacitors C83, C93 is amplified by means of an output amplifier OP83, OP93 in order to produce a positive peak value signal V83 and a negative peak value signal V93. The positive peak value signal V83 is in this case proportional to the positive peak value of the input current I1 during the positive half-cycle, and the negative peak value signal is proportional to the negative amplitude of the measurement current I1 during the negative half-cycle. The positive peak value signal V83, which is determined during the positive half-cycle, is held during the negative half-cycle, with reference to FIG. 12, while the negative peak value signal V93, which is determined during the negative half-cycle, is held during the positive half-cycle.

Switches are connected in parallel with the capacitors C83, C93, with the switch S83 which is connected in parallel with the capacitor C83 being closed for a short time at the start of a positive half-cycle, in order to discharge the capacitor C83 before the next charging process. A switch S93, which is connected in parallel with the capacitor C93, is in each case closed for a short time at the start of a negative half-cycle, in order to charge the capacitor C93 before the next charging process.

Drive signals for these two switches S83, S93 may, for example, be derived by means of a comparator, which is not illustrated, by comparison of the instantaneous value signals V43 and V53, in order to produce a square-mode signal with a rising flank at the start of a negative half-cycle, and with a falling flank at the start of a positive half-cycle. This comparator signal can be supplied to a first delay element (not illustrated), which closes the switch S93 for a predetermined time period after a rising flank of the comparator signal, and closes the switch S83 for a predetermined time period after a falling flank of the comparator signal.

Further assessment units, which further process the instantaneous value output signals V43, V53 or the peak value output signals V83, V93, are not illustrated in FIG. 11. This further processing can be carried out in a manner which has been known for a long time. In order, for example, to determine whether the positive amplitude of the input current I1 differs significantly from the negative amplitude of the measurement current I1, the difference between the peak value output signals V83, V93 could be determined in a simple manner, in order to produce an error signal if this difference exceeds a predetermined value, and to suppress further driving of the lamp.

The diagnosis circuit also has a lamp detector, which has a switch S33 which is connected between the input IN and the reference ground potential GND. This switch S33 is fitted in a manner that is not illustrated in any more detail on, for example, a lamp socket in which the lamp 10 is inserted, and is closed when no lamp is inserted in the socket. In this case, the measurement input IN is at the reference ground potential GND, as is identified by a comparator OP33 which compares the potential at the measurement input with a further reference potential REF33 in order to prevent the half-bridge circuit Q1, Q2 and the lamp (which is not present) from being driven.

Furthermore, the information about the positive and negative amplitudes of the measurement current I1, which are proportional to the positive and negative amplitudes of the lamp voltage 10, can be used in the control circuit 21 for the half-bridge circuit Q1, Q2 to vary the drive frequency in order in particular to optimize the preheating phase and the lamp starting process. In principle, a procedure such as this is described in the German Patent Application, submitted on the same date, entitled "Verfahren zur Ansteuerung einer eine Leuchtstofflampe aufweisenden Last zur Optimierung des Zündvorgangs" [Method for driving a load which has a fluorescent lamp, in order to optimize the starting process] inventors: Michael Herfurth, Martin Feldtkeller, Antoine Fery.

Figure 13:
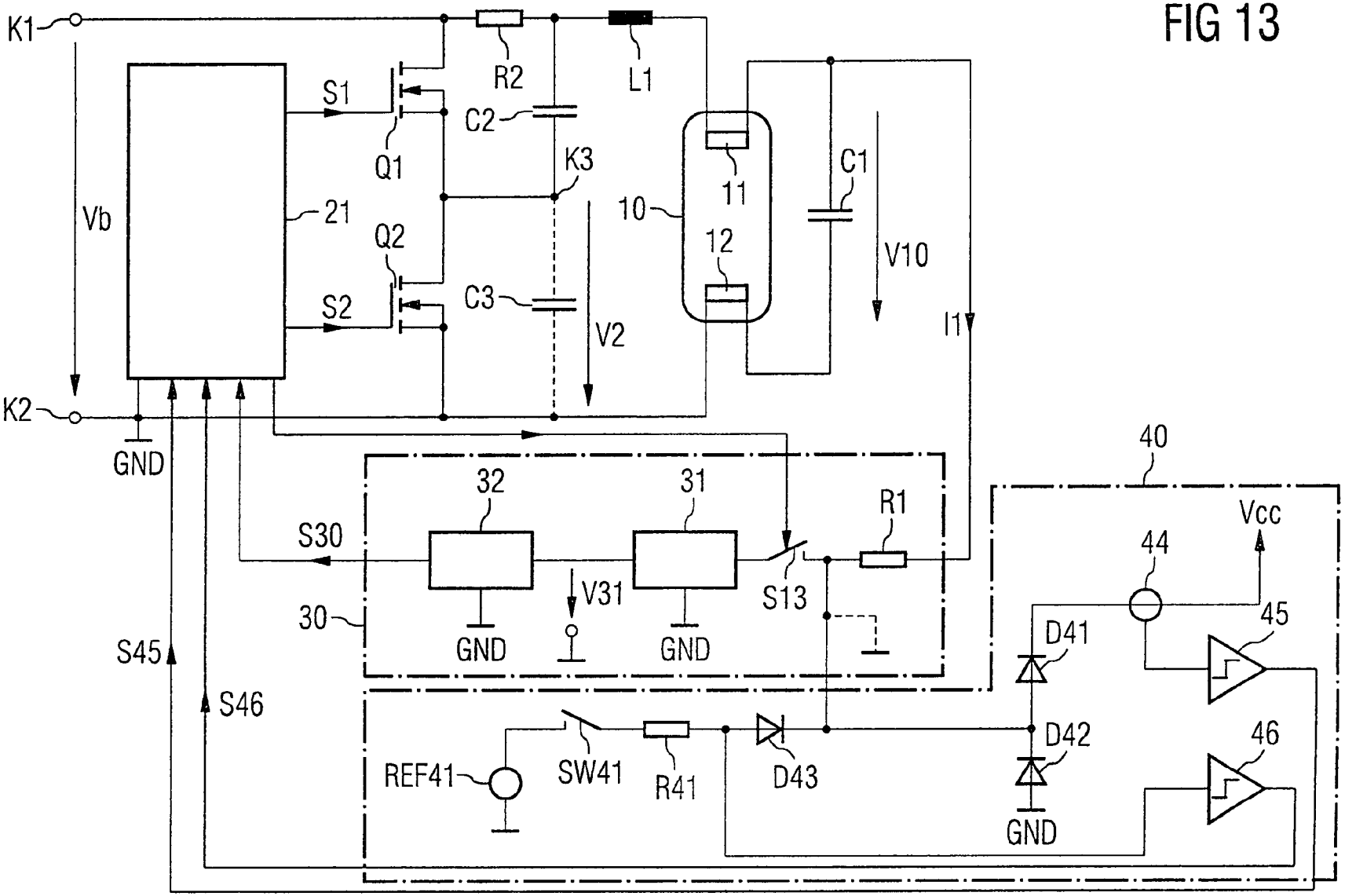
FIG. 13 shows one exemplary embodiment of a drive circuit, which has a direct-current path with a detector circuit connected to the direct-current path.
Figure 14:
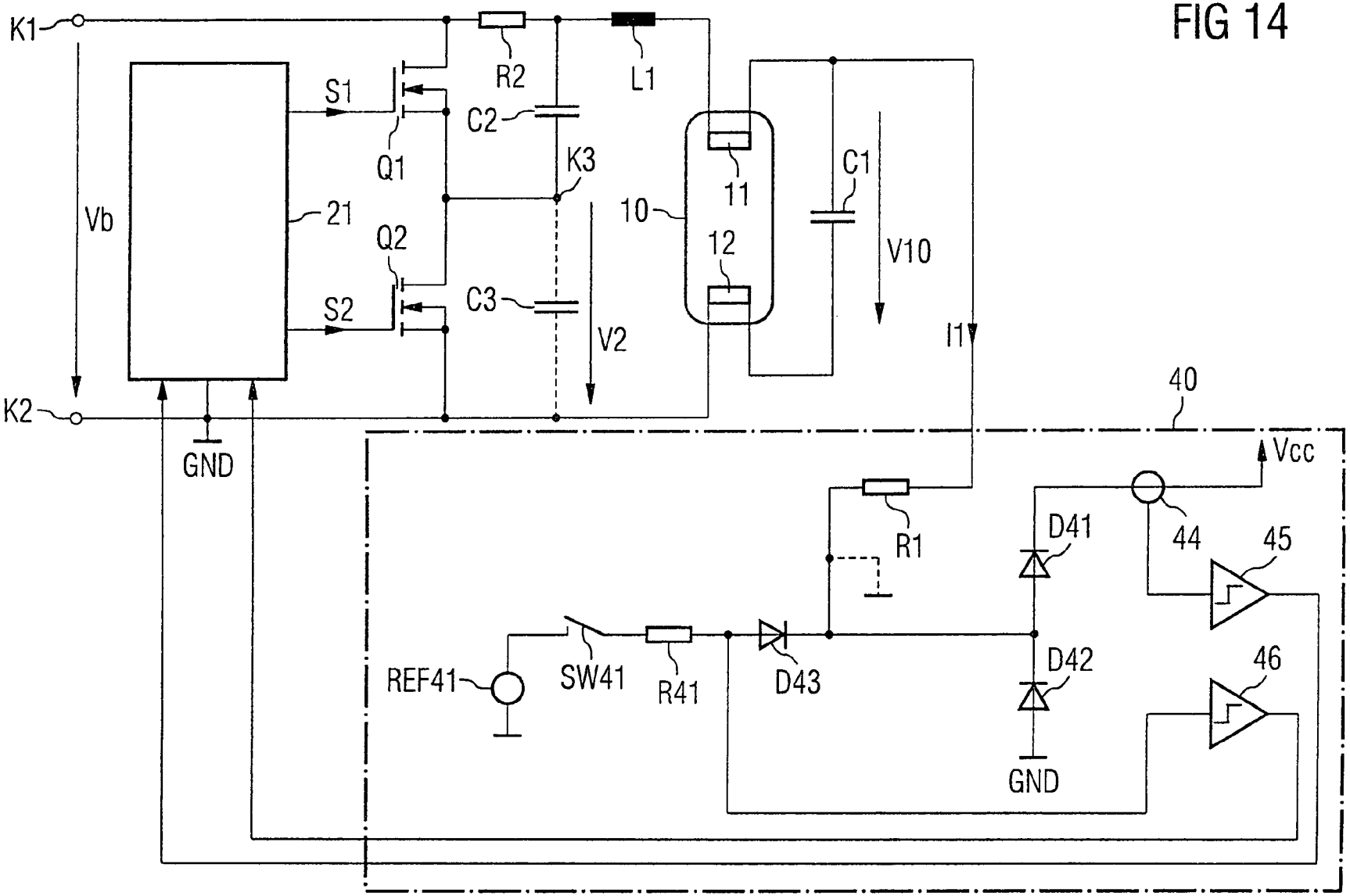
FIG. 14 shows a further exemplary embodiment of a drive circuit, which has a direct-current path with a detector circuit connected to the direct-current path.

FIGS. 13 and 14 show a further exemplary embodiment of a drive circuit and, respectively, of a lamp ballast for a fluorescent lamp. The resistance element R1 is in this case part of a direct-current path, to which a detector circuit 40 is coupled for detection of a current flowing through the direct-current path. In the exemplary embodiment, the direct-current path runs from the connecting terminal K1 for the half-bridge circuit Q1, Q2, to which a supply potential for the half-bridge circuit is applied, via a further resistance element R2, the resonant inductrance L1, the first lamp filament or lamp electrode 11 and the resistance element R1 to a terminal for a reference ground potential Vcc, in which case this reference ground potential Vcc is, for example, a supply potential for the components of the detector circuit 40 and of the drive circuit 21 which drives the half-bridge circuit Q1, Q2. This direct-current path, which runs via the first lamp filament 11 in the fluorescent lamp 10, is closed only when a fluorescent lamp 10 is inserted and when the first lamp filament 11 is intact, that is to say it is electrically conductive.

The detector circuit 40 has a current detector 44, which is connected in the direct-current path and is coupled to an evaluation circuit 45, which produces a first detector signal S45 which is supplied to the control circuit 21.

A first diode D41 is preferably connected in the direct-current path in the detector circuit 40 and allows current to flow only in the direction shown for the current I1 in FIG. 13. In order to limit the voltage in the detector circuit 40 in the event of a current flowing in the opposite direction to this, a second diode D42 is provided, and is connected between the reference ground potential GND and the node which is common to the resistance element R1 and the first diode D41.

The direct-current path in conjunction with the detector circuit 40 is used to identify whether a fluorescent lamp 10 is present, and whether the lamp is intact. This drive circuit prevents the half-bridge circuit Q1, Q2 from being driven by the control circuit 21 when the control circuit receives information via the first detector signal S45 that the direct current flowing via the direct-current path is below a predetermined threshold, thus indicating that no fluorescent lamp 10 has been inserted, or that the fluorescent lamp 10 is not intact. The comparison threshold for the detected current is produced in the example by a threshold detector 45, to which the current detector 44 is coupled.

The resistance elements R1, R2 in the direct-current path are selected, by way of example, such that the direct current which flows through the direct-current path when an intact fluorescent lamp 10 is inserted is between about 20 μA and 200 μA.

The detector circuit 40 can be used in particular in conjunction with the already explained diagnosis circuit 30, as is illustrated in FIG. 13. In this case, a switch S13 is connected between the resistance element R1 and the other components, that is to say the current/voltage converter 31 and the evaluation circuit 32 for the diagnosis circuit 30, as is also illustrated in FIG. 11. This switch S13 is likewise driven by the control circuit 21. In this context, it should be noted that the control circuit 21 for the half-bridge circuit Q1, Q2, the diagnosis circuit 30 and the detector circuit 40 preferably form a common integrated control circuit for the lamp ballast, and are integrated in a common semiconductor chip.

The method of operation of the arrangement shown in FIG. 13 will be explained in the following text:

When the ballast is switched on, with DC voltage Vb being applied to the input terminals K1, K2, the half-bridge circuit Q1, Q2 is initially not driven, and the switch S13 is opened, driven by the control circuit 21. As soon as the detector circuit 40 detects a direct current above the predetermined threshold flowing through the direct-current path, the control circuit 21 starts to drive the half-bridge circuit Q1, Q2, with the switch S13 being closed after the start or in conjunction with the start of this drive, in order to subsequently carry out a diagnosis of possible wear of the fluorescent lamp, via the diagnosis circuit 30.

If the evaluation circuit 32 in the diagnosis circuit 30 detects wear of the fluorescent lamp 10, which is signaled to the control circuit 21 via the diagnosis signal S30, the drive to the half-bridge Q1, Q2 is interrupted, in order to interrupt the voltage supply to the fluorescent lamp. In addition, the switch S13 is opened again by the control circuit 21, and the current flowing through the direct-current path is evaluated once again by the detector circuit 40.

After an interruption in the drive to the half-bridge as a result of wear, the control circuit 21 uses the first detector signal S45 to detect whether the current flowing through the direct-current path has risen after a delay time from zero to a positive value. The rise in this direct current from zero to a positive value which is above a predetermined threshold once a delay time has elapsed following the half-bridge having been switched off as a result of wear indicates that a user has replaced the fluorescent lamp, in which case the control circuit drives the half-bridge Q1, Q2 again once such a lamp change has been detected.

The embodiment illustrated in FIG. 14 does not require a switch S13, with the detector circuit 40 being used without the components 31, 32 of the diagnosis circuit 30 that detects the wear.

The detector circuit 40 can optionally include a reference voltage source REF41, a resistor R41 connected in series with the reference voltage source REF41, and a further diode D43, with the series circuit comprising the reference voltage source REF41, the switch SW41, the resistor R41 and the diode D43 being connected between the reference ground potential GND and the resistance element R1. A second threshold value detector 46 is connected to the node which is common to the resistor R41 and to the diode D43, and supplies a second detector signal S46 to the control circuit 21. The switch SW41 is likewise driven in a manner that is not described in any more detail by the control circuit 21, and is closed before the start of the half-bridge Q1, Q2, when the switch S13 is opened. The node which is common to the diode D43 and the resistor R1 is then at a potential which corresponds at least to the reference potential REF41.

This node which is common to the diode D43 and to the resistor R1 represents an interface between the integrated control circuit with the components 21, 30, 40 and the "outside world". If the manufacturer of the ballast connects this node to a reference ground potential GND, which is in fact done only when the manufacturer does not fit the resistance elements R1, R2 in the circuit, then it is possible in this way to signal to the control circuit 21 that the resistance elements R1, R2 are not fitted, and that the diagnosis circuit should not be used, overall. This information is signaled to the control circuit 21 via the second detector signal S46 from the second threshold detector 46, which evaluates the potential at the node which is common to the resistor R41 and the diode D43.

The operation of the half-bridge is also enabled by the control circuit 21 when the diagnosis circuit is not in use, with the switch S13 in this case not being closed.

The option that has been explained is worthwhile in the case of integrated control circuits, which can be used optionally for one or more lamps and which have a corresponding number of diagnosis circuits, in order to shut down those diagnosis circuits which are not required.

The invention claimed is:

1. A drive circuit for at least one fluorescent lamp comprising:

a half-bridge circuit configured to produce a supply voltage;

a resonant circuit coupled to the half-bridge circuit configured to be connected to the at least one fluorescent lamp;

a diagnosis circuit comprising a resistance element coupled to the resonant circuit, at least one current/voltage converter connected to the resistance element and configured to produce at least one measurement voltage based on a current flowing through the resistance element; and an evaluation circuit operably coupled to the current/voltage converter to receive the at least one measurement voltage;

wherein the current/voltage converter is configured to produce a first measurement voltage representative of a voltage across the at least one fluorescent lamp during a first half-cycle and to produce a second measurement voltage representative of a voltage across the fluorescent lamp during a second half-cycle; and wherein the evaluation circuit comprises:

a first peak value detection unit coupled to receive the first measurement voltage and configured to produce a first peak value signal;

a second peak value detection unit coupled to receive the second measurement voltage and configured to produce a second peak value signal; and an assessment unit configured to produce a diagnosis signal as a function of a comparison of the first and second peak value signals.

2. The drive circuit of claim 1 wherein the diagnosis signal assumes a level indicating that the at least one fluorescent lamp is worn when one of the first and second peak value signals is less than the respective other of the first and second peak value signal by more than a predetermined factor that is less than unity.

3. The drive circuit of claim 1 wherein the first peak value detection unit includes a series circuit comprising a first rectifier arrangement and a first capacitive storage element and wherein the second peak value detection unit includes a series circuit comprising a second rectifier arrangement and a second capacitor storage element.

4. The drive circuit of claim 3 wherein the assessment unit comprises a first switching unit, a second switching unit, a third capacitive storage element and a fourth capacitive storage element and wherein the first switching unit connects the third capacitive storage element in parallel with the first capacitive storage element to produce a comparison signal on the parallel circuit and the second switching unit connects the fourth capacitive storage element in parallel with the second capacitive storage element to produce a second comparison signal on the parallel circuit.

5. The drive circuit of claim 1 wherein the assessment unit is configured to alternatively compare one of the first and second peak value signals with a comparison signal corresponding to the respective other of the first and second peak value signals multiplied by a predetermined factor less than unity.

6. The drive circuit of claim 1 wherein which a current/voltage converter comprises:

an inverting input amplifier having an inverting input, a non-inverting input and an output and wherein the inverting input is connected to the resistance element and to the output;

a first peak value detector coupled to the output of the input amplifier and configured to produce a first peak value signal from an output signal of the input amplifier; and a second peak value detector coupled to the inverting input of the input amplifier and configured to produce a second peak value signal from a signal which is applied to the inverting input of the input amplifier.

7. The drive circuit of claim 1 wherein the current/voltage converter comprises:

an inverting input amplifier having an inverting input, a non-inverting input and an output, wherein the inverting input is connected to the resistance element and to the output;

a first instantaneous value amplifier coupled to the output of the input amplifier and configured to produce a first instantaneous value signal from an output signal from the input amplifier; and a second instantaneous value amplifier coupled to the inverting input of the input amplifier and configured to produce a second instantaneous value signal from a signal which is applied to the inverting input of the input amplifier.

8. The drive circuit of claim 1 further comprising a direct-current path containing the resistance element, the direct-current path adapted to be closed by an intact lamp filament in the fluorescent lamp; and a detector circuit connected to the direct-current path and configured to detect a direct current flowing through the direct-current path.

9. The drive circuit of claim 8 further comprising a control circuit for the half-bridge circuit and wherein the detector circuit produces a detector signal dependent on the detection of the direct current through the direct-current path and the detector signal is supplied to the control circuit.

10. The drive circuit of claim 9 wherein the control circuit is configured to inhibit driving of the half-bridge circuit when the detector signal indicates that the direct current flowing through the direct-current path is below a predetermined current threshold.

11. The drive circuit of claim 8 wherein the direct-current path further comprises a further resistance element connected in series with connections for the lamp filament.

12. The drive circuit of claim 11 wherein the direct-current path is located between a connection for a supply potential for the half-bridge circuit and a reference ground potential.

13. The drive circuit of claim 12 wherein the reference ground potential is a supply potential for the control circuit or for the detector circuit.

14. The drive circuit of claim 8 wherein the detector circuit comprises a current detector connected in the direct-current path and coupled to the evaluation circuit.

15. The drive circuit of claim 14 further comprising a switch connected between the resistance element and the current/voltage converter.

16. The drive circuit of claim 15 wherein the switch is configured to open after application of a supply voltage to the half-bridge circuit, the control circuit is configured to drive the half-bridge circuit only after detection of a direct current above a predetermined threshold value flowing through the direct-current path, and the switch is closed when the half-bridge circuit is being driven.

17. The drive circuit of claim 16 wherein a driving signal of the half-bridge circuit is interrupted when the diagnosis signal indicates that the at least one is worn fluorescent lamp and the half-bridge circuit is driven again only when the direct current through the direct-current path falls below a predetermined first threshold value after a delay time and then rises to a value above a predetermined second threshold value.

18. A drive circuit for at least one fluorescent lamp comprising:

a half-bridge circuit configured to produce a supply voltage;

a resonant circuit coupled to the half-bridge circuit configured to be connect to the at least one fluorescent lamp;

a diagnosis circuit comprising a resistance element coupled to the resonant circuit, at least one current/voltage converter connected to the resistance element and configured to produce at least one measurement voltage based on a current flowing through the resistance element; and an evaluation circuit operably coupled to the current/voltage converter to receive the at least one measurement voltage;

wherein the evaluation circuit comprises:

a first peak value detection unit to coupled to receive the at least one measurement voltage and configured to produce a first peak value signal;

a second peak value detection unit coupled to receive the at least one measurement voltage and configured to produce a second peak value signal; and an assessment unit configured to produce a diagnosis signal as a function of a comparison of the first and second peak value signals.

19. The drive circuit of claim 18 wherein the diagnosis signal assumes a level indicating that the at least one fluorescent lamp is worn when one of the first and second peak value signals is less than the respective other of the first and second peak value signal by more than a predetermined factor that is less than unity.

20. The drive circuit of claim 18 wherein the first peak value detection unit includes a series circuit comprising a first rectifier arrangement and a first capacitive storage element and wherein the second peak value detection unit includes a series circuit comprising a second rectifier arrangement and a second capacitor storage element.

21. The drive circuit of claim 20 wherein the assessment unit comprises a first switching unit, a second switching unit, a third capacitive storage element and a fourth capacitive storage element and wherein the first switching unit connects the third capacitive storage element in parallel with the first capacitive storage element to produce a comparison signal on the parallel circuit and the second switching unit connects the fourth capacitive storage element in parallel with the second capacitive storage element to produce a second comparison signal on the parallel circuit.

22. The drive circuit of claim 18 wherein the assessment unit is configured to alternatively compare one of the first and second peak value signals with a comparison signal corresponding to the respective other of the first and second peak value signals multiplied by a predetermined factor less than unity.

23. The drive circuit of claim 18 wherein which a current/voltage converter comprises:

an inverting input amplifier having an inverting input, a non-inverting input and an output and wherein the inverting input is connected to the resistance element and to the output;

a first peak value detector coupled to the output of the input amplifier and configured to produce a first peak value signal from an output signal of the input amplifier; and a second peak value detector coupled to the inverting input of the input amplifier and configured to produce a second peak value signal from a signal which is applied to the inverting input of the input amplifier.

24. The drive circuit of claim 18 wherein the current/voltage converter comprises:

an inverting input amplifier having an inverting input, a non-inverting input and an output, wherein the inverting input is connected to the resistance element and to the output;

a first instantaneous value amplifier coupled to the output of the input amplifier and configured to produce a first instantaneous value signal from an output signal from the input amplifier; and a second instantaneous value amplifier coupled to the inverting input of the input amplifier and configured to produce a second instantaneous value signal from a signal which is applied to the inverting input of the input amplifier.

25. The drive circuit of claim 18 further comprising a direct-current path containing the resistance element, the direct-current path adapted to be closed by an intact lamp filament in the fluorescent lamp; and a detector circuit connected to the direct-current path and configured to detect a direct current flowing through the direct-current path.

26. The drive circuit of claim 25 further comprising a control circuit for the half-bridge circuit and wherein the detector circuit produces a detector signal dependent on the detection of the direct current through the direct-current path and the detector signal is supplied to the control circuit.

27. The drive circuit of claim 26 wherein the control circuit is configured to inhibit driving of the half-bridge circuit when the detector signal indicates that the direct current flowing through the direct-current path is below a predetermined current threshold.

28. The drive circuit of claim 25 wherein the direct-current path further comprises a further resistance element connected in series with connections for the lamp filament.

29. The drive circuit of claim 28 wherein the direct-current path is located between a connection for a supply potential for the half-bridge circuit and a reference ground potential.

30. The drive circuit of claim 29 wherein the reference ground potential is a supply potential for the control circuit or for the detector circuit.

31. The drive circuit of claim 25 wherein the detector circuit comprises a current detector connected in the direct-current path and coupled to the evaluation circuit.

32. The drive circuit of claim 31 further comprising a switch connected between the resistance element and the current/voltage converter.

33. The drive circuit of claim 32 wherein the switch is configured to open after application of a supply voltage to the half-bridge circuit, the control circuit is configured to drive the half-bridge circuit only after detection of a direct current above a predetermined threshold value flowing through the direct-current path, and the switch is closed when the half-bridge circuit is being driven.

34. The drive circuit of claim 33 wherein a driving signal of the half-bridge circuit is interrupted when the diagnosis signal indicates that the at least one is worn fluorescent lamp and the half-bridge circuit is driven again only when the direct current through the direct-current path falls below a predetermined first threshold value after a delay time and then rises to a value above a predetermined second threshold value.

35. A drive circuit for at least one fluorescent lamp comprising:

a half-bridge circuit configured to produce a supply voltage;

a resonant tuned circuit coupled to the half-bridge circuit and configured to be connected to the at least one fluorescent lamp;

a direct-current path comprising a resistance element, the direct current path being configured to be closed by an intact lamp filament in the fluorescent lamp;

a detector circuit connected to the direct-current path configured to detect a direct current flowing through the direct-current path;

a switch connected between the resistance element and a current/voltage converter; and a control circuit for the half-bridge circuit and wherein the detector circuit is configured to produce a detector signal dependent on the detection of the direct current in the direct-current path which detector signal is supplied to the control circuit;

wherein the direct-current path further comprises a further resistance element connected in series with connections for the lamp filament;

wherein the switch is opened after application of a supply voltage to the half-bridge circuit, the control circuit drives the half-bridge circuit only after detection of a direct current above a predetermined threshold value flowing through the direct-current path, and the switch is closed when the half-bridge circuit is being driven; and wherein the control circuit is configured to prevent driving of the half-bridge circuit when the detector signal indicates that a direct current flowing through the direct-current path is below a predetermined current threshold.

36. The drive circuit of claim 35 wherein the detector circuit comprises a current detector connected in the direct-current path and an evaluation circuit coupled to the detector circuit.

* * * * *